US008317187B2

(12) United States Patent
Kondo et al.

(10) Patent No.: US 8,317,187 B2
(45) Date of Patent: Nov. 27, 2012

(54) RECORDING APPARATUS

(75) Inventors: Katsuyuki Kondo, Nagano-ken (JP); Shintaro Komuro, Nagano-ken (JP); Satoshi Kawamura, Nagano-ken (JP); Shoma Kudo, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 13/267,143

(22) Filed: Oct. 6, 2011

(65) Prior Publication Data

US 2012/0086164 A1 Apr. 12, 2012

(30) Foreign Application Priority Data

Oct. 6, 2010 (JP) ..... 2010-226382
Feb. 18, 2011 (JP) ..... 2011-032930

(51) Int. Cl.
*B65H 1/08* (2006.01)

(52) U.S. Cl. ..... 271/127; 271/145; 271/149

(58) Field of Classification Search ..... 271/126, 271/127, 145, 149, 164; 378/182, 188; 206/449, 206/455; 399/393
See application file for complete search history.

(56) References Cited

U.S. PATENT DOCUMENTS 4,583,873 A * 4/1986 Parks et al. ..... 400/629
5,265,865 A * 11/1993 Agano et al. ..... 271/1
5,387,043 A 2/1995 Fujioka et al.
5,441,251 A * 8/1995 Ohta ..... 271/145
6,252,683 B1 * 6/2001 Kawamura et al. ..... 358/498
6,412,772 B1 * 7/2002 Itoh et al. ..... 271/145
6,641,047 B2 * 11/2003 Ito et al. ..... 235/475
7,940,428 B2 5/2011 Shimizu
2008/0217840 A1 * 9/2008 Shiraki et al. ..... 271/126
2010/0321746 A1 12/2010 Yazawa et al.

FOREIGN PATENT DOCUMENTS

JP 05-325729 12/1993
JP 06-079935 3/1994
JP 2002-205859 7/2002
JP 2006-205630 8/2006
JP 2007-191297 8/2007
JP 2008-087932 4/2008

* cited by examiner

*Primary Examiner* — Jeremy R Severson

(57) ABSTRACT

A recording apparatus of the disclosure includes a recording unit that performs a recording process on a subject recording medium, a cassette body that accommodates the subject recording medium, a subject recording medium cassette opening that is provided in the cassette body and supplies the subject recording medium therefrom, a movable portion that switches to a closed state in which the subject recording medium cassette opening is closed or an opened state in which the subject recording medium is able to be supplied from the subject recording medium cassette opening, a lock portion that locks the movable portion in the closed state, and an insertion portion that is provided in the movable portion so that a feeding roller is able to be inserted therethrough.

4 Claims, 21 Drawing Sheets

259a
259
282
281
285c
285b
285a
285
246
245
241
206
286a
286b
286c
286
287
284b
284a
284c
284

RECORDING APPARATUS

CROSS-REFERENCE TO RELATED APPLICATIONS

Priority is claimed under 35 U.S.C. §119 to Japanese Application Nos. 2010-226382, filed Oct. 6, 2010, and 2011-032930, filed Feb. 18, 2011, which are hereby incorporated by reference in their entirety.

BACKGROUND

1. Technical Field

The present invention relates to a recording apparatus.

2. Related Art

A recording apparatus represented as a facsimile or a printer may be formed as a vertical installation-type, for example, in order to save installation space (especially to save space in a plane direction) or for other reasons. That is, the dimensions in the height direction at the time of installing the apparatus may be set to be larger than at least any one of the dimensions in the width direction and the dimensions in the depth direction, and such a recording apparatus is disclosed in, for example, JP-A-2006-205630, JP-A-2002-205859, JP-A-06-79935, JP-A-05-325729, and JP-A-2007-191297.

However, in the recording apparatus, a sheet cassette (which may be called a sheet tray) accommodating a sheet may be provided so as to be attachable to or detachable from a recording apparatus body, and JP-A-2006-205630 discloses an apparatus in which a sheet feeding tray is attachably or detachably provided in a printer used in a longitudinally elongated state.

On the other hand, as a structure which supplies an accommodated sheet to a sheet cassette, a structure may be adopted in which a sheet accommodated in a sheet cassette is raised up toward a feeding roller in addition to a structure in which a pickup roller moving close to or away from an accommodated sheet is used in a sheet cassette.

For example, in JP-A-2007-191297, a recording medium protrudes from a sheet cassette of which the upper portion is opened by rotating a pressing plate using the force of a tension coil spring and the uppermost recording medium is made to come into contact with a feeding roller (a sheet feeding roller). Accordingly, the contacting recording medium is transported by the feeding roller.

In the case of a non-vertical installation-type recording apparatus that horizontally accommodates a sheet, a structure may be adopted in which the front end side of a cassette is largely opened so as to make the sheet come into contact with the feeding roller. However, in the case of the vertical installation-type recording apparatus, when a structure is adopted in which the front end side of the cassette is largely opened, the sheet spills out when making the cassette stand up.

Further, when the hopper-up type feeding structure is adopted in such a configuration, there is a need that a blocked portion (a cover) near the front end of the cassette is adapted to be movable (openable or closeable). However, when the cover is easily opened in the state where the sheet cassette is detached from the apparatus body, the sheet spills out from the sheet cassette.

Likewise, in the recording apparatus including the sheet cassette accommodating the sheet with a vertical posture or an inclined posture, there are problems in that the sheet may spill out when making the sheet cassette stand up in the state where the sheet cassette is attached to the apparatus body, and the sheet may spill out from the sheet cassette in the state where the sheet cassette is detached from the apparatus body.

SUMMARY

In order to solve the above-described problem, according to a first aspect of the invention, there is provided a recording apparatus that performs a recording process on a subject recording medium, the recording apparatus including: a recording unit that performs a recording process on the subject recording medium; a subject recording medium cassette body that accommodates the subject recording medium in a vertical posture or an inclined posture while being attached to the recording apparatus; a subject recording medium cassette opening that is provided in the subject recording medium cassette body and supplies the subject recording medium therefrom; a movable portion that is provided in the subject recording medium cassette body and switches to a closed state in which the subject recording medium cassette opening is closed or an opened state in which the subject recording medium is able to be supplied from the subject recording medium cassette opening; and a lock portion that locks the movable portion in the closed state while the subject recording medium cassette body is detached from the recording apparatus.

According to this aspect, since the lock portion is provided which locks the movable portion in a closed state in the state where the subject recording medium cassette body is detached from the recording apparatus, even when the subject recording medium cassette body is detached from the recording apparatus, the subject recording medium cassette opening is not easily opened, and the subject recording medium may be reliably prevented from spilling out from the subject recording medium cassette body.

According to a second aspect of the invention, there is provided the recording apparatus according to the first aspect, wherein the lock portion may include a mechanism that releases the locked state of the movable portion in accordance with an operation in which the subject recording medium cassette body is attached to the recording apparatus and locks the movable portion in accordance with an operation in which the subject recording medium cassette body is detached from the recording apparatus.

According to this aspect, since the lock portion is configured to be locked or released in accordance with an operation in which the subject recording medium cassette body is attached to or detached from the recording apparatus, the user does not need to perform the locking operation or the lock releasing operation by himself or herself, the operation may be easily performed, and the locked state is reliably guaranteed when the subject recording medium cassette body is detached from the recording apparatus, thereby reliably obtaining the effect of the first aspect.

According to a third aspect of the invention, there is provided the recording apparatus according to the second aspect, wherein a boss portion may be formed in the movable portion, and wherein the lock portion may include: a lock member that displaces between a locked position in which the lock member engages with the boss portion so as to lock the movable portion and a lock release position in which the engagement between the lock member and the boss portion is released so as to release the locked state of the movable portion and a biasing member that biases the lock member toward the locked position.

According to this aspect, since the lock portion includes the lock member and the biasing member, the structure may be simplified and the lock portion may be provided at low cost.

According to a fourth aspect of the invention, there is provided the recording apparatus according to the second aspect, further including: a frame that accommodates the subject recording medium cassette body; and an engagement member that is formed in the frame and engages with the lock portion so as to release the locked state of the movable portion.

According to this aspect, in the recording apparatus, the same effect as that of the second aspect may be obtained.

According to the fifth aspect of the invention, there is provided the recording apparatus according to the first to fourth aspects, wherein the dimensions of the apparatus in the height direction at the time of installing the apparatus may be larger than at least any one of the dimensions in the width direction and the dimensions in the depth direction.

According to this aspect, since the recording apparatus is formed as a vertical installation-type in which the dimensions of the apparatus in the height direction at the time of installing the apparatus is larger than at least any one of the dimensions in the width direction and the dimensions in the depth direction, that is, the recording apparatus is formed as a "vertical installation-type", in the vertical installation-type recording apparatus capable of saving an installation space, the same effect as that of any one of the first to fourth aspects may be obtained.

According to a sixth aspect of the invention, there is provided a recording apparatus that performs a recording process on a subject recording medium, the recording apparatus including: a recording unit that performs a recording process on the subject recording medium; a subject recording medium cassette body that accommodates the subject recording medium in a vertical posture or an inclined posture while being attached to the recording apparatus; a subject recording medium cassette opening that is provided in the subject recording medium cassette body and supplies the subject recording medium therefrom; a feeding roller that supplies the subject recording medium from the subject recording medium cassette opening to the recording unit; a movable portion that is provided in the subject recording medium cassette body and moves the subject recording medium accommodated in the subject recording medium cassette body in a direction in which the subject recording medium comes into contact with the feeding roller; an insertion portion that is provided in the movable portion so that the feeding roller is able to be inserted therethrough and is set to be shorter than the length of the width direction intersecting the transportation direction of the subject recording medium.

According to this aspect, the accommodation portion accommodating the recording medium is provided with the movable portion, and the movable portion is provided with the insertion portion which allows the feeding roller to access (come into rolling-contact with) the recording medium. For this reason, the overall portion without the insertion portion in the movable portion serves as a support portion which maintains the upright posture of the recording medium. Accordingly, it is possible to reliably prevent the recording medium accommodated in the upright posture from spilling out and prevent the feeding roller from disturbing the supply of the recording medium.

According to a seventh aspect of the invention, there is provided the recording apparatus according to the sixth aspect, wherein the insertion portion may include a plurality of partial insertion portions through which a plurality of roller bodies attached to a roller shaft of the feeding roller at an interval are respectively inserted.

According to this aspect, each of a plurality of roller bodies ensuring the appropriate transportation of the recording medium may come into rolling-contact with the recording medium while being inserted through each partial insertion portion. Accordingly, it is possible to reliably transport the recording medium using the feeding roller and reliably maintain the upright posture of the recording medium.

According to an eighth aspect of the invention, there is provided the recording apparatus according to the sixth aspect, further including: a forward moving mechanism that biases the movable portion so as to move from a separation position in which the feeding roller and the recording medium are separated from each other to a contact position in which the feeding roller and the recording medium come into contact with each other; a backward moving mechanism that moves the movable portion from the contact position to the separation position against the biasing force of the forward moving mechanism; and a power transmission mechanism that transmits power from a power supply source to the backward moving mechanism whenever supplying each recording medium.

According to this aspect, the movable portion may be accurately moved between the contact position and the separation position by the forward moving mechanism generating a biasing force and the backward moving mechanism pressing backward against the biasing force. Further, even when a plurality of recording media is accommodated inside the movable portion by the power transmission mechanism, one recording medium coming into contact with the feeding roller at the contact position may be reliably transported.

According to a ninth aspect of the invention, there is provided the recording apparatus according to the eighth aspect, wherein the forward moving mechanism may include a pressing arm which is rotatably supported by using the base end thereof as a support axis and of which the front end comes into contact with the subject recording medium cassette body and a spring that rotatably biases the pressing arm.

According to this aspect, since the forward moving mechanism and the backward moving mechanism are configured as mechanisms which are simple and have few breakdowns, the movable portion may be stably and reliably moved.

BRIEF DESCRIPTION OF THE DRAWINGS

The invention will be described with reference to the accompanying drawings, wherein like numbers reference like elements.

FIG. 18 is a perspective view illustrating a recording medium cassette, a moving unit, a feeding roller, and the like.

FIG. 19 is a front view illustrating the recording medium cassette, the moving unit, the feeding roller, and the like.

FIGS. 20A and 20B are side views illustrating the recording medium cassette, the moving unit, the feeding roller, and the like.

DESCRIPTION OF EXEMPLARY EMBODIMENTS

First Embodiment

Figure 1:
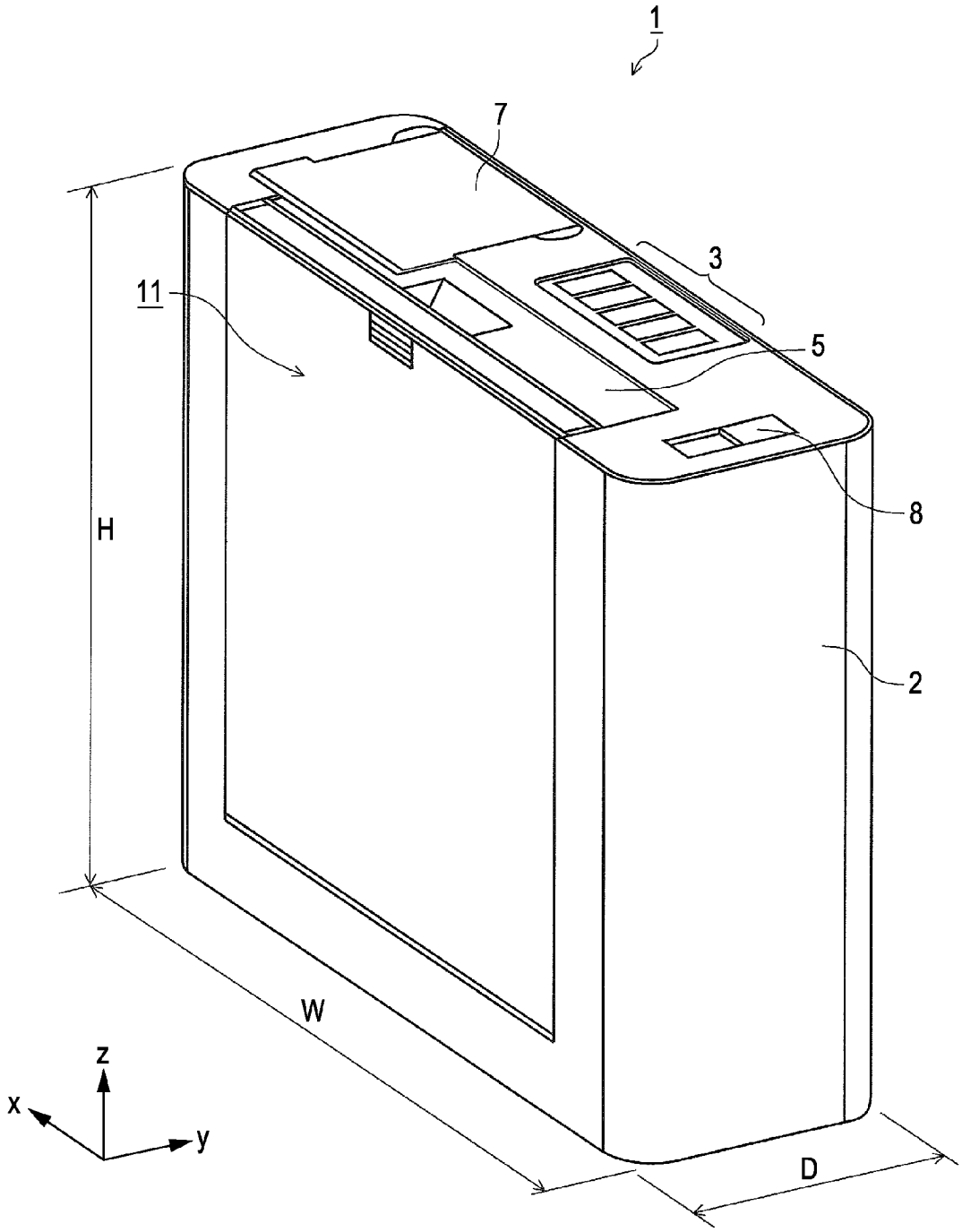
FIG. 1 is an external perspective view illustrating the overall appearance of a recording apparatus.
Figure 2:
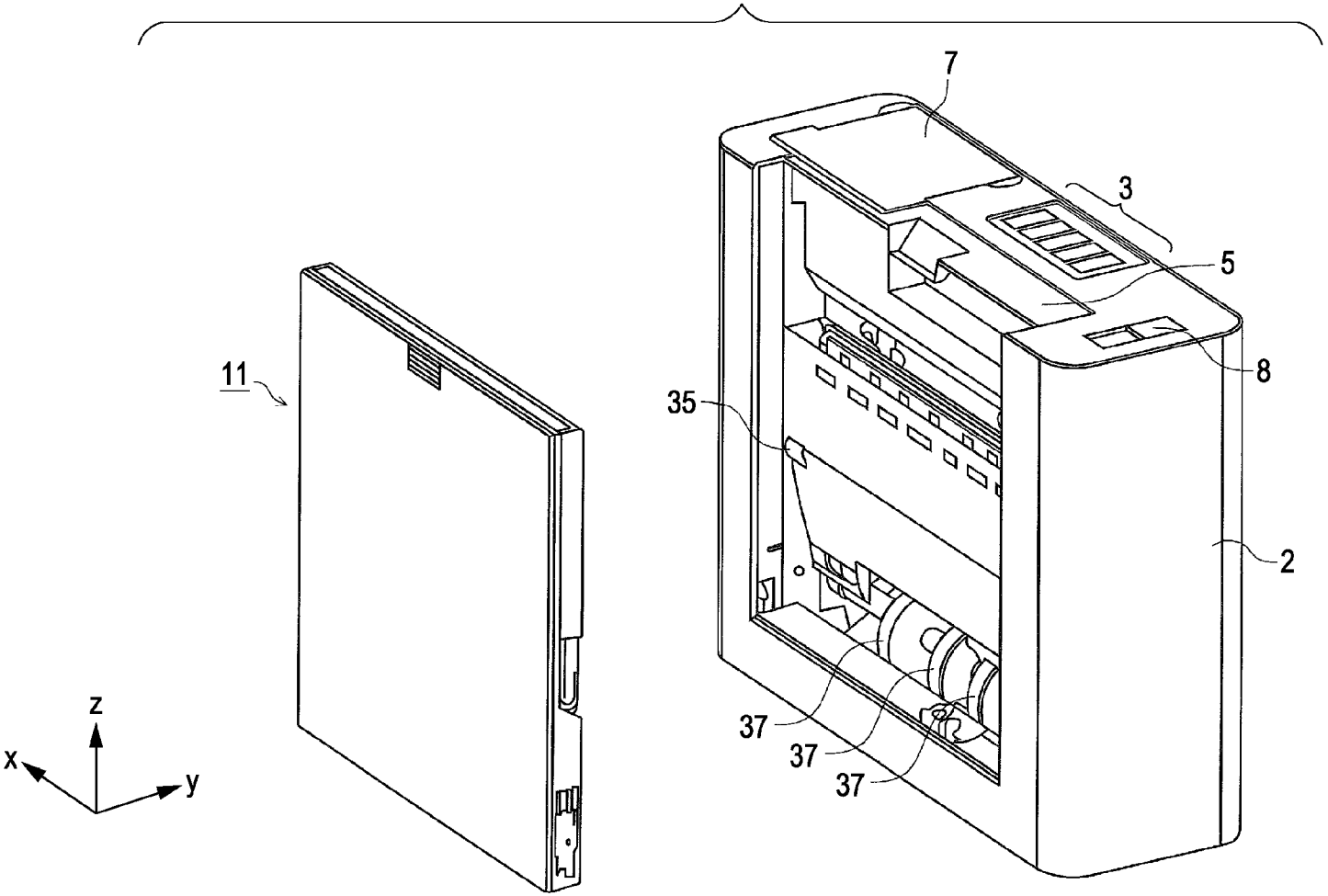
FIG. 2 is an external perspective view illustrating the recording apparatus in the state where a sheet cassette is detached.
Figure 3:
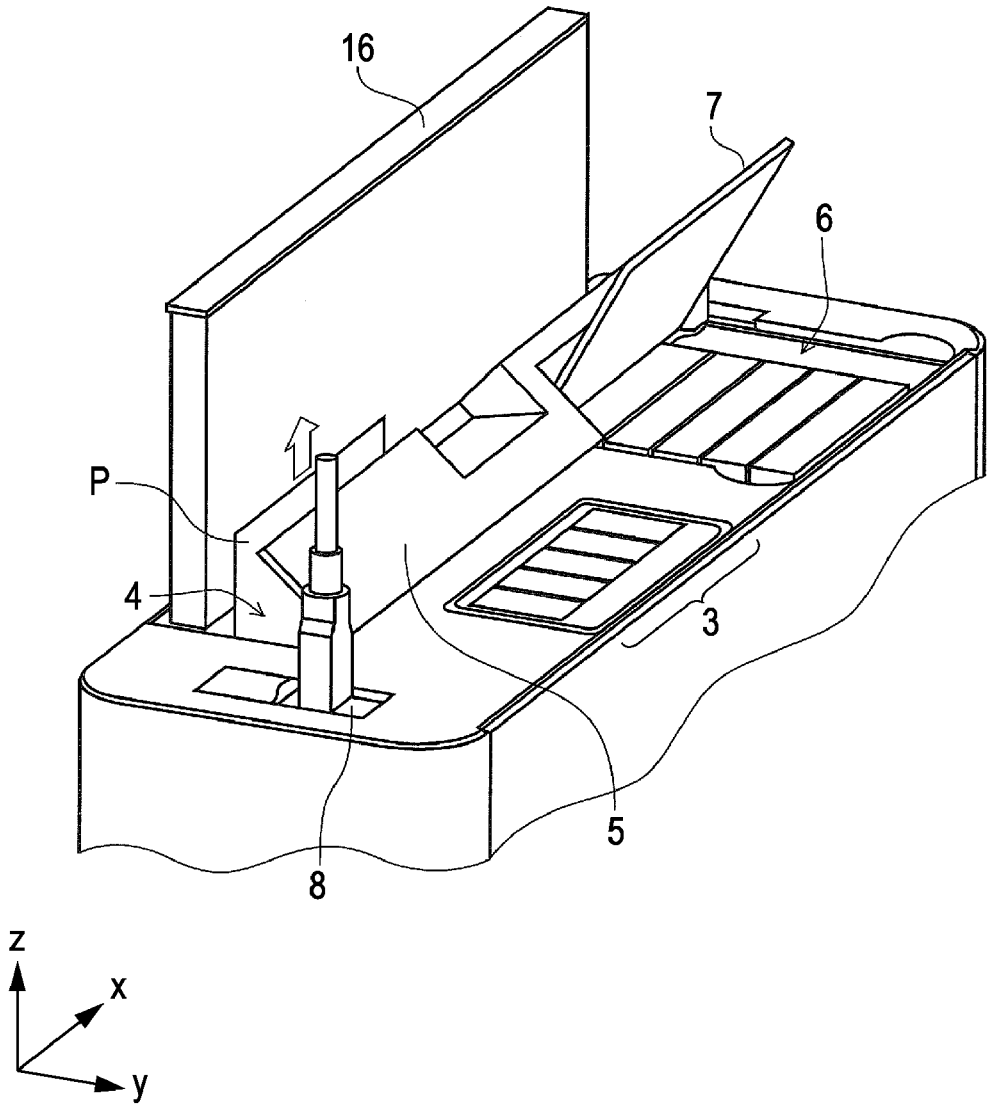
FIG. 3 is an external perspective view illustrating an upper part of the recording apparatus.
Figure 6:
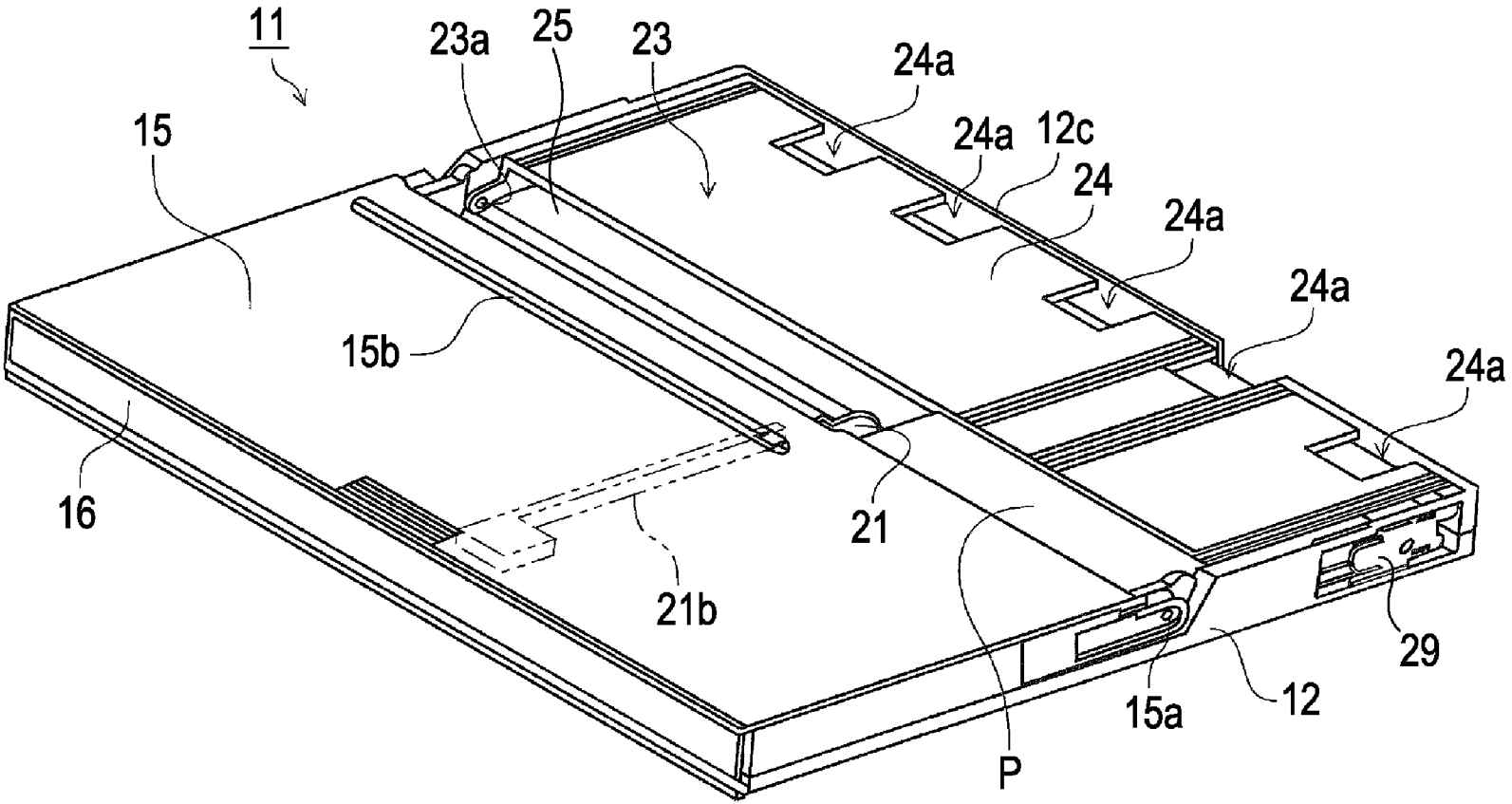
FIG. 6 is an external perspective view illustrating a sheet cassette (in the state where an upper cover is closed).
Figure 7:
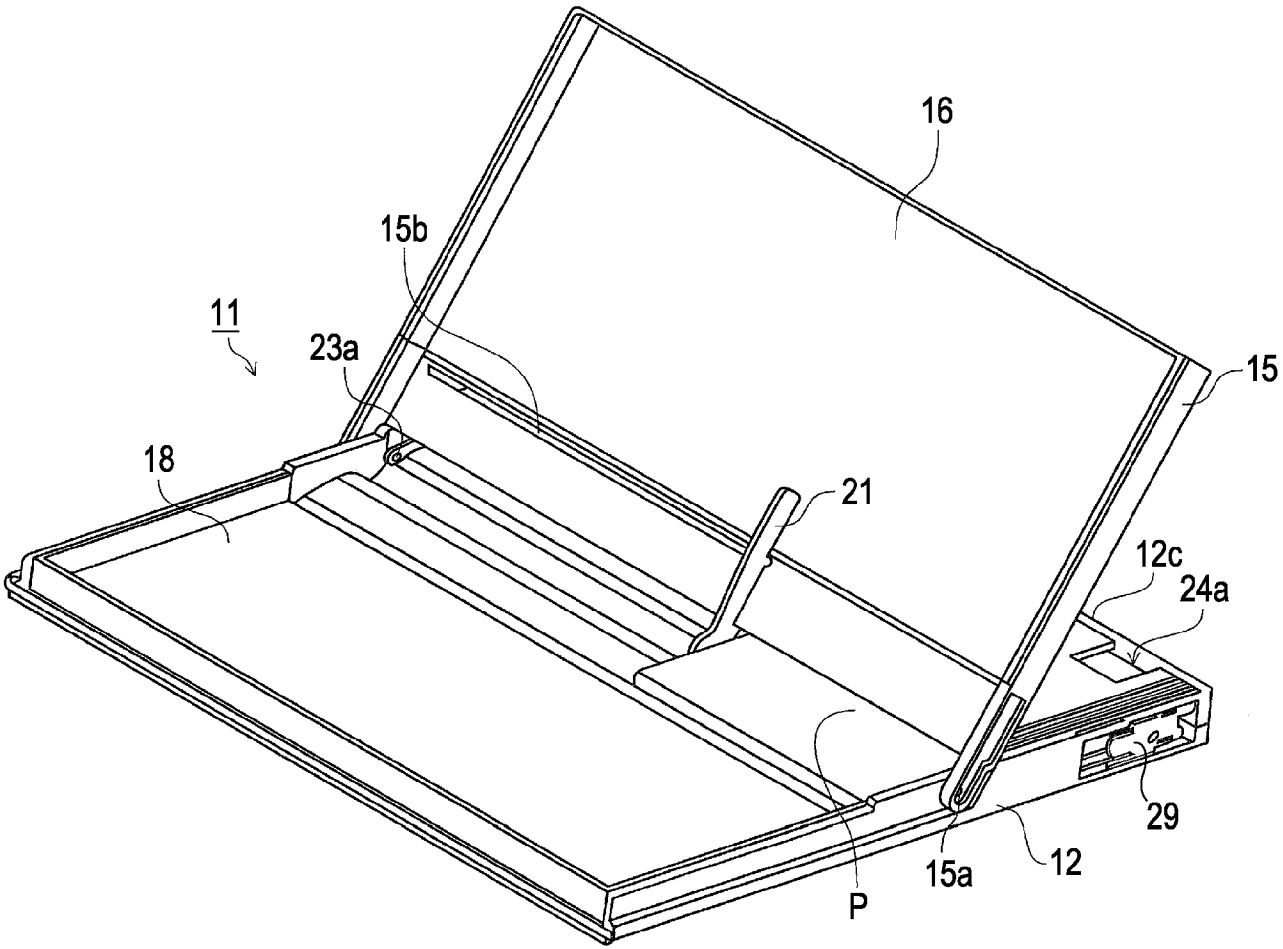
FIG. 7 is an external perspective view illustrating the sheet cassette (in the state where the upper cover is opened).

Hereinafter, referring to FIG. 1 to FIG. 13B, an ink jet printer which is an embodiment of a recording apparatus according to the invention will be described. FIG. 1 is an external perspective view illustrating an overall appearance of an ink jet printer 1 according to the embodiment, FIG. 2 is an external perspective view illustrating a state where a sheet cassette 11 is detached, FIG. 3 is an external perspective view illustrating an upper part of the ink jet printer 1, FIGS. 4 and 5 are the same side cross-sectional views, and FIGS. 6 and 7 are external perspective views of the sheet cassette 11 (FIG. 6 illustrates a state where an upper cover is closed and FIG. 7 illustrates a state where the upper cover is opened).

Figure 8:
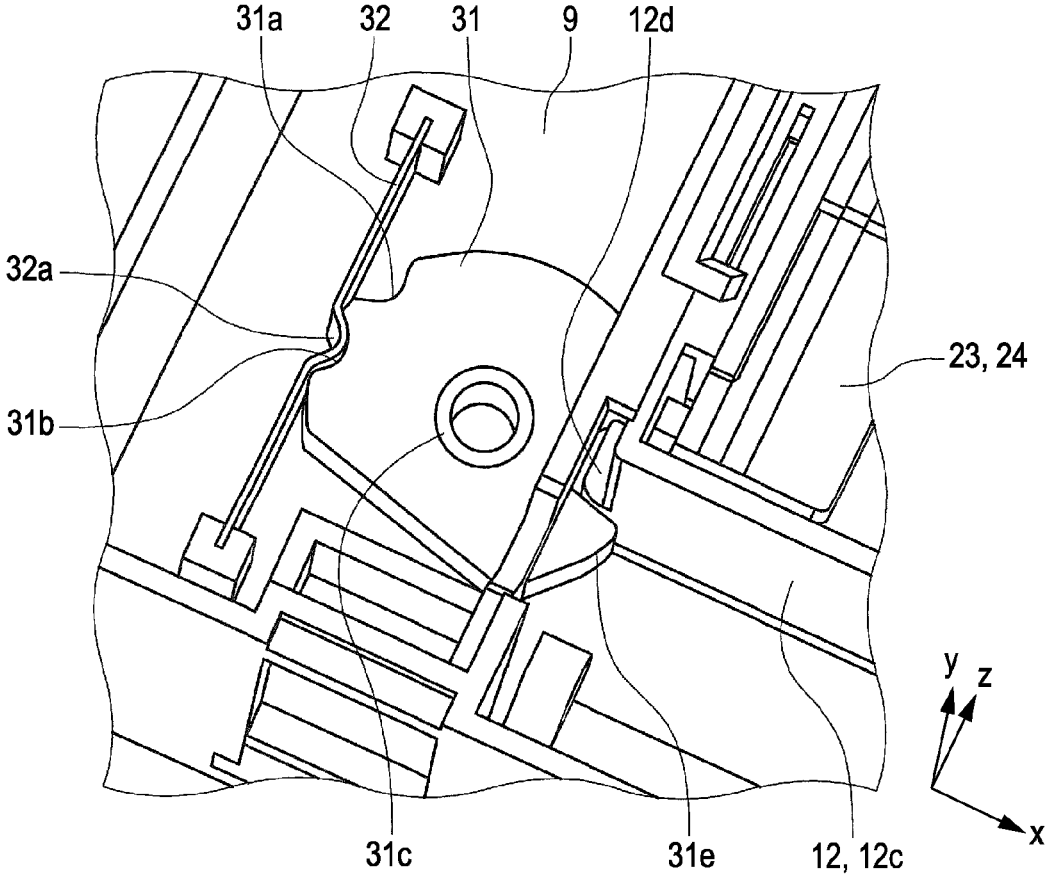
FIG. 8 is a perspective view illustrating an attachment portion of a positioning damper.
Figure 9:
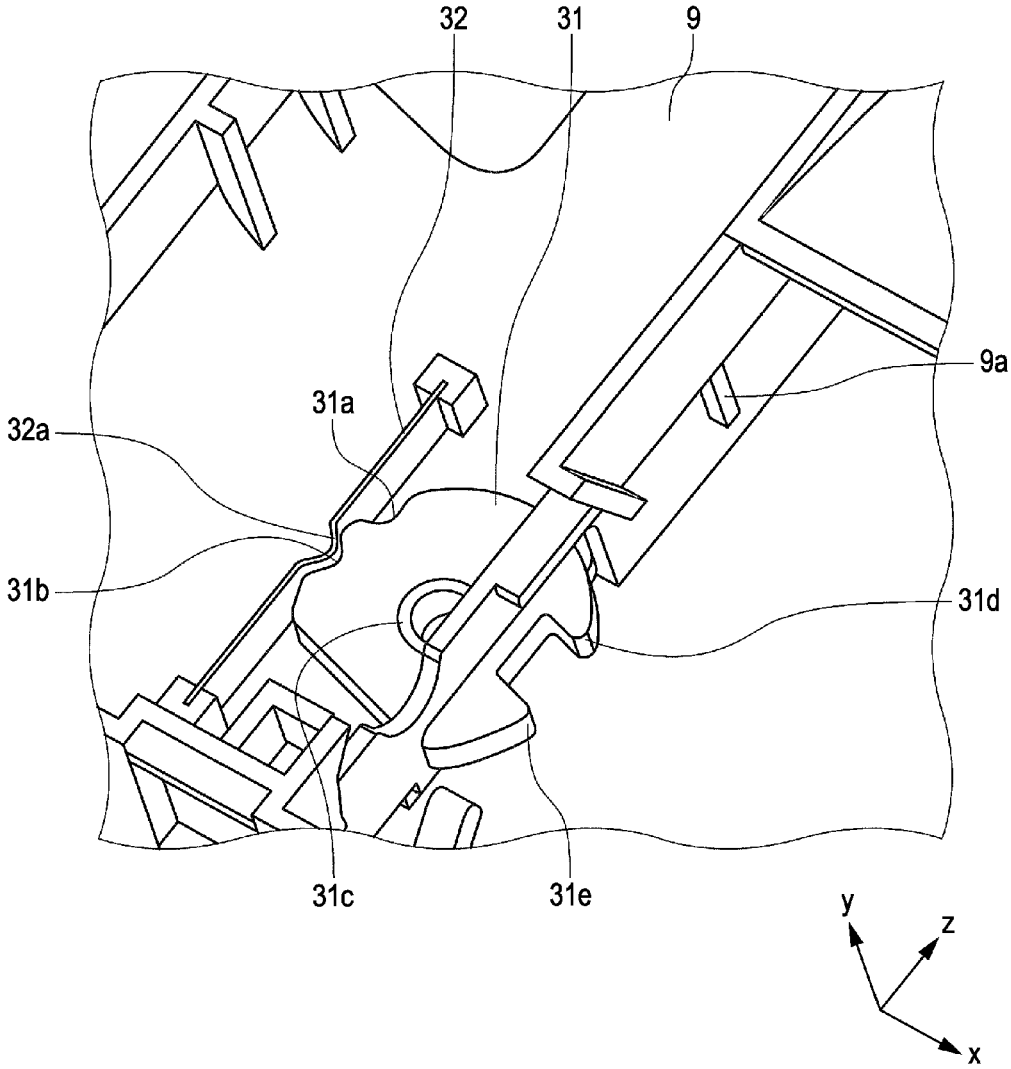
FIG. 9 is a perspective view illustrating the attachment portion of the positioning damper.
Figure 10B:
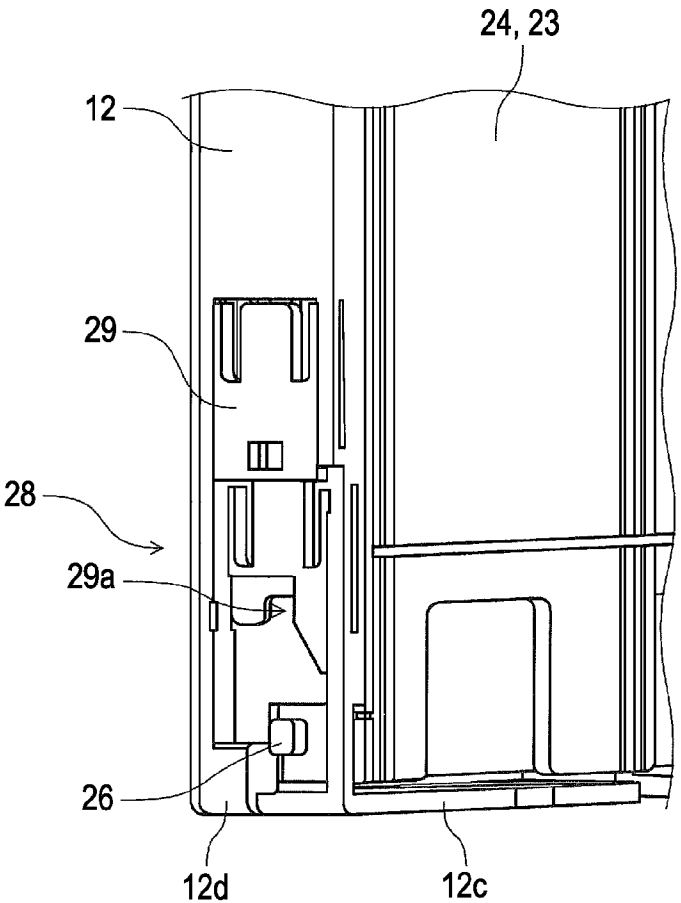
FIG. 10B is a perspective view illustrating the lock unit (in a lock release state).
Figure 10A:
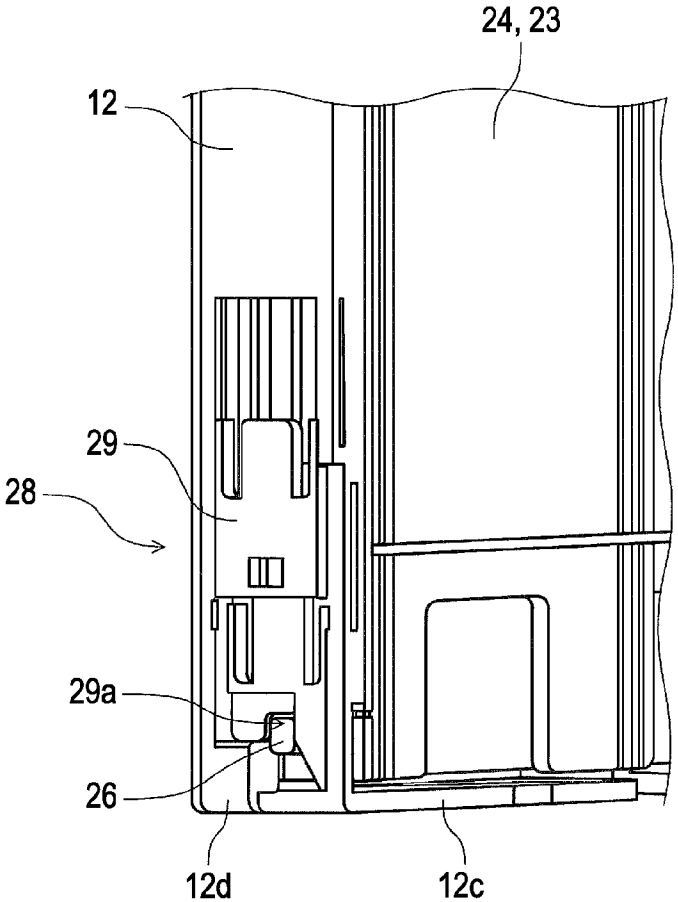
FIG. 10A is a perspective view illustrating a lock unit (in a locked state)
Figure 11:
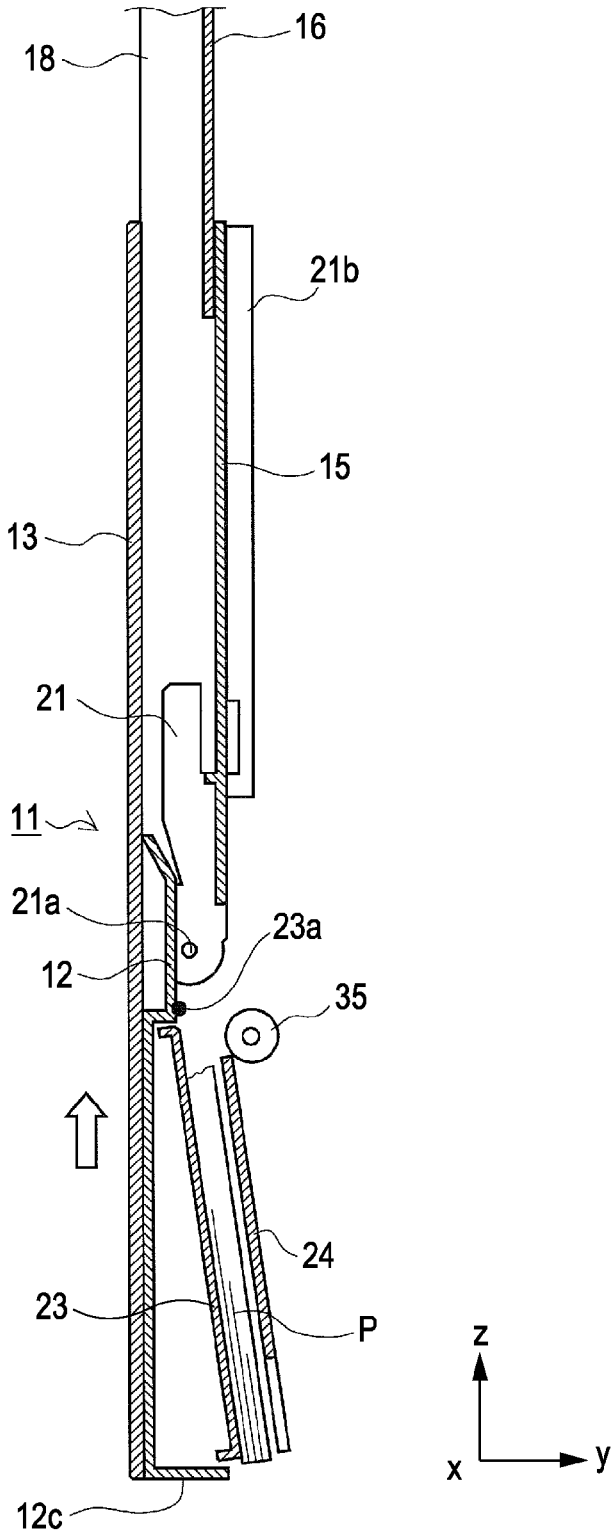
FIG. 11 is a diagram illustrating a function of a return roller.
Figure 12:
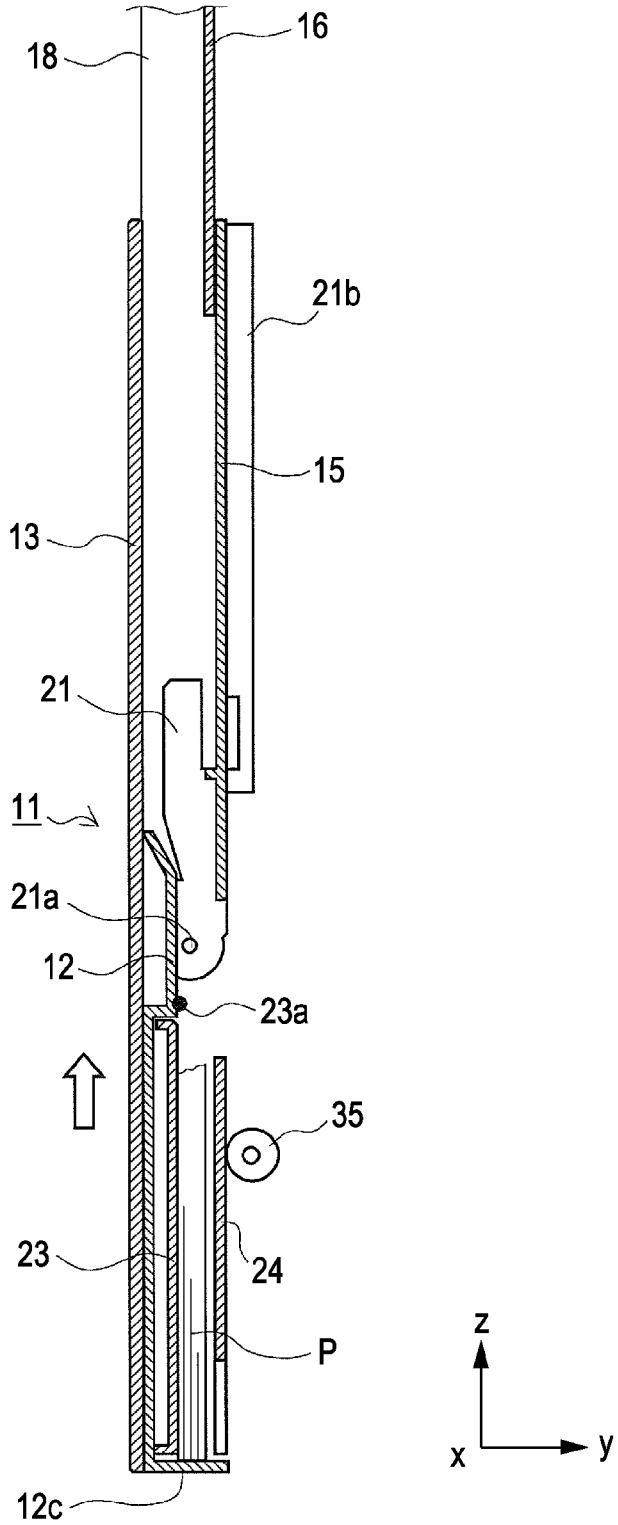
FIG. 12 is a diagram illustrating a function of the return roller.
Figure 13B:
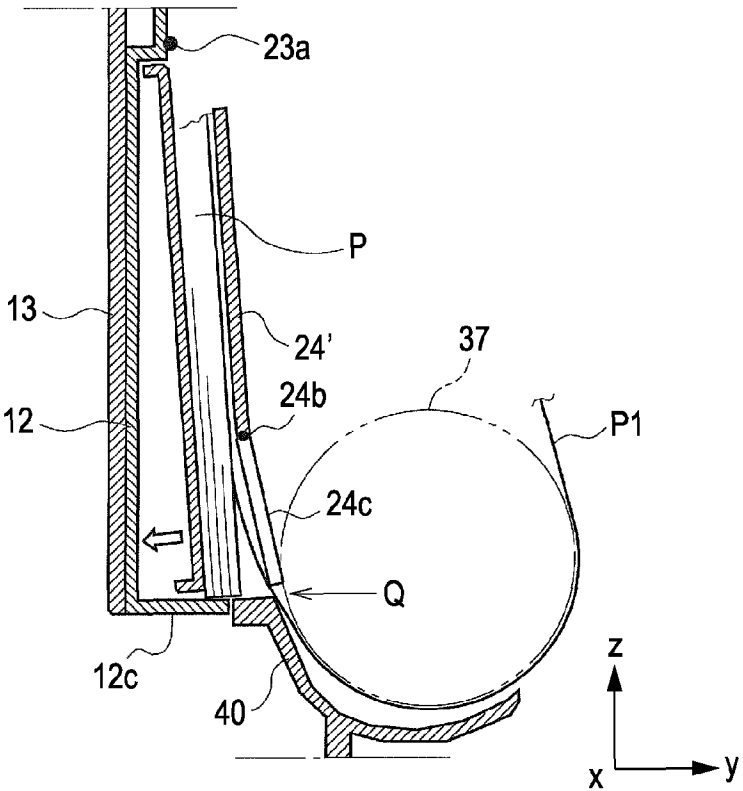
FIGS. 13A and 13B are diagrams illustrating another embodiment of a movable tray.
Figure 13A:
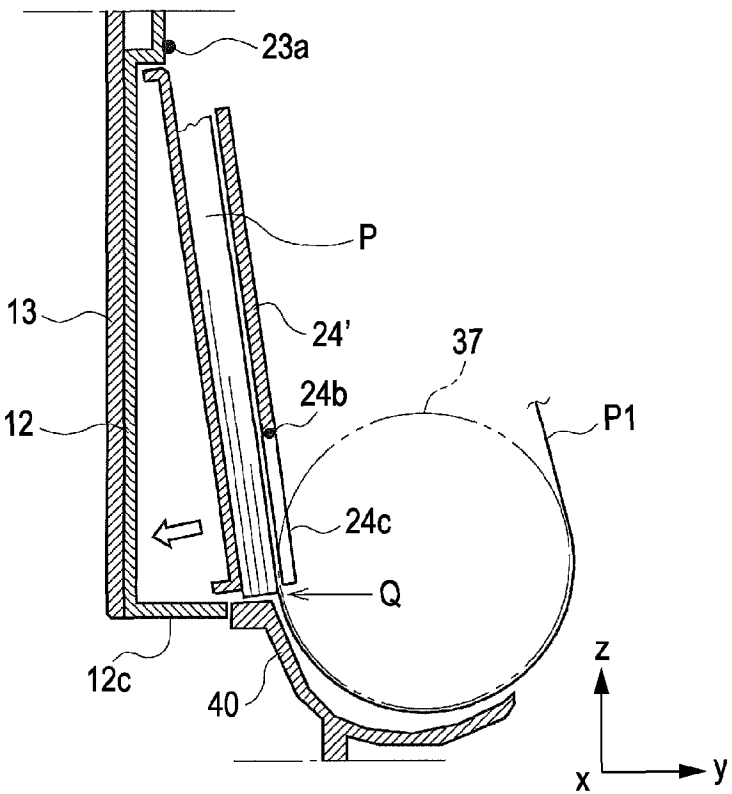

Further, FIGS. 8 and 9 are perspective views illustrating an attachment portion of a positioning damper 31, FIG. 10A is a perspective view illustrating a lock unit 28 (in a locked state), FIG. 10B is a perspective view illustrating the lock unit 28 (in a lock release state), FIGS. 11 and 12 are diagrams illustrating a function of a return roller 35, and FIGS. 13A and 13B are diagrams illustrating another embodiment of a movable tray 23.

Figure 4:
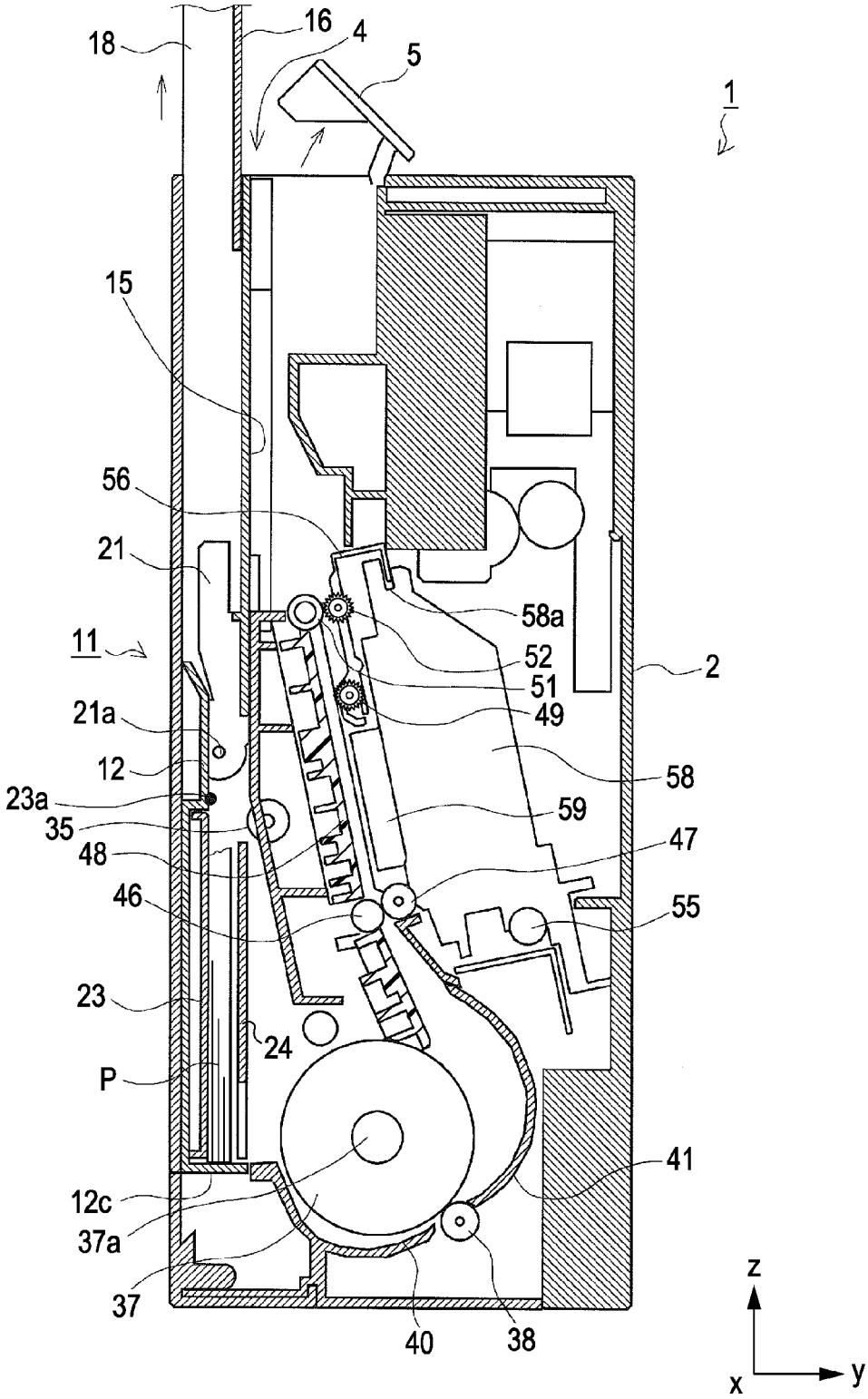
FIG. 4 is a side cross-sectional view illustrating the recording apparatus.
Figure 5:
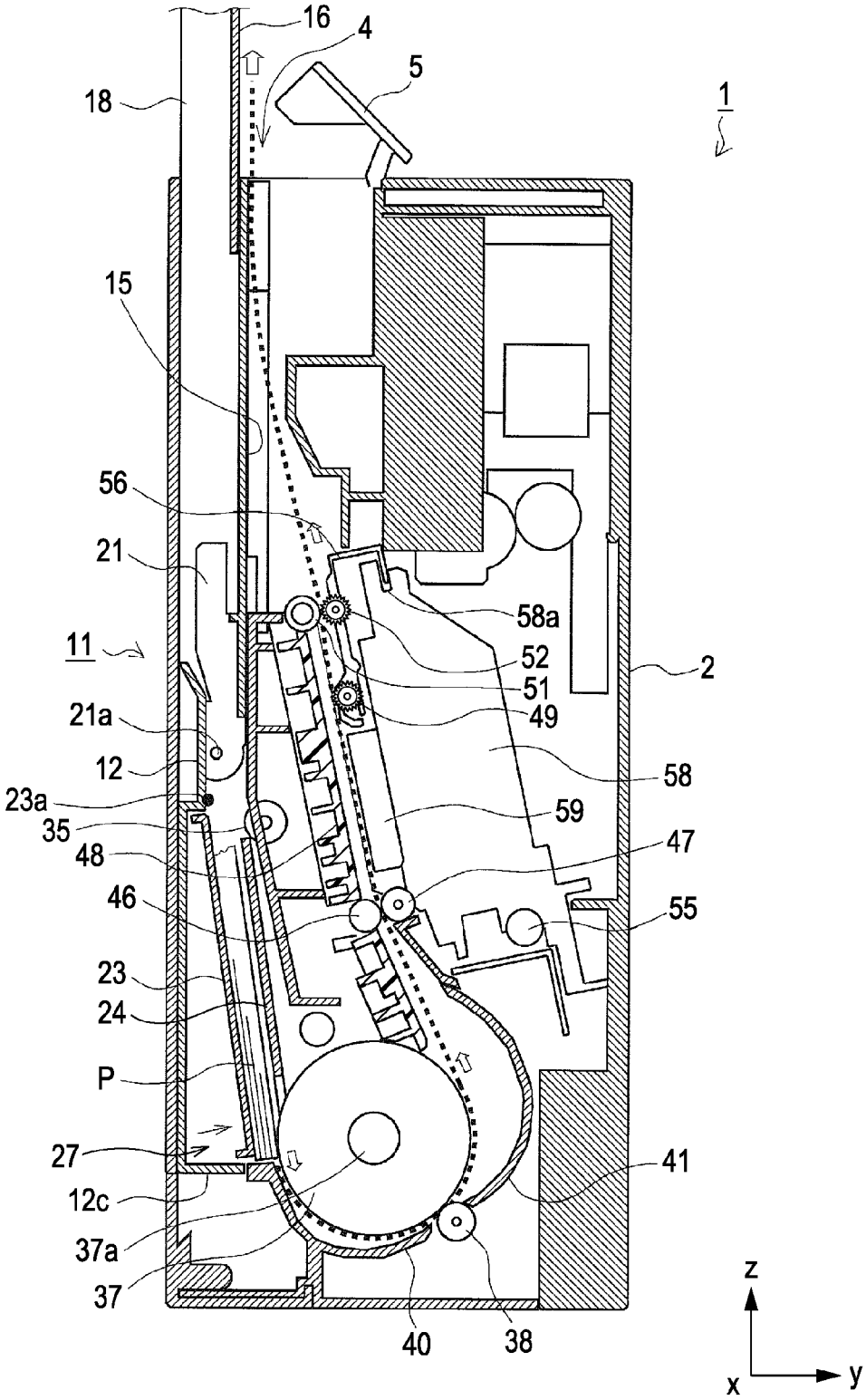
FIG. 5 is a side cross-sectional view illustrating the recording apparatus.

Furthermore, in FIGS. 4 and 5, almost all of the rollers are drawn on the same plane in order to show the rollers disposed in a sheet transportation path of the ink jet printer 1, but the invention is not limited to being positioned on the same plane in the sheet width direction (the direction perpendicular to the figures of FIGS. 4 and 5) (some rollers may be positioned on the same plane). Further, regarding the x-y-z coordinate system of the drawings, the x direction indicates the apparatus width direction and the sheet width direction, the y direction indicates the apparatus depth direction (hereinafter, in some cases, the "apparatus thickness direction"), and the z direction indicates the apparatus height direction (the vertical direction).

1. Overall Configuration of Ink Jet Printer

Hereinafter, an overall configuration of the ink jet printer 1 will be described. The ink jet printer 1 is a vertical ink jet printer of which the dimensions in the height direction when installed is larger than at least any one of the dimensions in the width direction and the depth direction. In the embodiment, the dimensions in the height direction (the reference numeral H in FIG. 1) is set to be larger than any one of the dimensions in the width direction (the reference numeral W in FIG. 1) and the dimensions in the depth direction (the reference numeral D in FIG. 1). Further, in the embodiment, the dimension W in the width direction is set to be larger than the dimension D in the depth direction.

Furthermore, the depth direction (the y direction) or the width direction (the x direction) is used for convenience of description in the specification. That is, the invention is not limited to the wide surface in the width direction (the x direction) facing a user when installing the apparatus. The narrow surface in the depth direction (the y direction) may face the user or the apparatus may be provided in an inclined direction different from the above-described directions. However, when the apparatus is provided in a certain direction, the height direction (the z direction) certainly corresponds to the direction along the vertical (gravity) direction.

The external appearance of the ink jet printer 1 is formed by a casing 2 which is thin and has a box shape, where the top surface of the apparatus is provided with a manipulation panel 3 including a manipulation button and the like or an interface cable connection portion 8 used for the connection of an interface cable.

Further, the top surface of the apparatus is provided with an ink cartridge attachment portion to or from which a plurality of ink cartridges 6 may be attached or detached, and the reference numeral 7 denotes an ink cartridge cover which opens or closes the ink cartridge attachment portion. Furthermore, the ink cartridge cover 7 is opened and closed by the user when replacing the ink cartridges 6.

Further, the top surface of the apparatus is provided with a sheet discharge port 4 which is used to discharge a sheet having an image recorded thereon, and the reference numeral 5 denotes a sheet discharge port cover which opens or closes the sheet discharge port 4. Furthermore, the sheet discharge port cover 5 is configured to be opened or closed by the user and is configured to be automatically opened by an opening and closing mechanism (not shown) when a recording operation starts in a closed state.

In FIG. 2, the reference numeral 11 denotes a sheet cassette which may accommodate (set) a plurality of recording sheets (a cut form sheet: hereinafter, referred to as a "sheet P") in a pile shape. As shown in FIG. 2, the sheet cassette 11 is configured to be attached to or detached from the casing 2. As shown in FIG. 1, when the sheet cassette is attached, the sheet cassette forms the appearance of the ink jet printer 1. When the sheet cassette is detached, the sheet transportation path inside the apparatus is exposed, so that a sheet jam process or the like may be performed. Furthermore, the operation of attaching or detaching the sheet cassette 11 is performed in a manner such that the sheet cassette 11 is slid in the z direction while being positioned at the position of FIG. 4 in the y direction.

As shown in FIGS. 6 and 7, the sheet cassette 11 is substantially formed by installing an openable or closeable upper outer cover 15 and a movable tray 23 serving as a "pivotable movable portion" in a cassette body 12 serving as a "tray-shaped subject recording medium cassette body". The upper outer cover 15 may be switched to a closed state shown in FIG. 6 or an opened state shown in FIG. 7 by rotating about a rotation point 15*a* provided at the substantial center of the cassette body 12. Then, in the opened state of the upper outer cover 15, as shown in FIG. 7, the sheet accommodation space of the cassette body 12 is exposed, so that the sheet P may be accommodated.

In the state where the sheet cassette 11 is attached, the cassette upper portion (the left portion shown in FIGS. 6 and 7) is configured to be expanded and contracted according to the size of the sheet. Specifically, an upper slide tray 18 is configured to slide in the sheet sending direction (the vertical direction in the cassette attachment state) with respect to the cassette body 12.

Further, an upper inner cover 16 is configured to slide in the sheet sending direction with respect to the upper outer cover 15, and when the upper slide tray 18 and the upper inner cover 16 are slid according to the size of the sheet, a sheet accommodation space appropriate for the size of the sheet may be formed (the state of FIG. 5).

Next, an edge guide 21 is provided in the cassette body 12 so as to be slidable in the sheet width direction, and the edge of the set sheet P is guided at a position appropriate for the size of the sheet by the edge guide 21. Furthermore, the upper outer cover 15 is provided with an elongated hole 15*b* extending in the displacement direction of the edge guide 21, and a part of the edge guide 21 may protrude from the elongated hole 15*b* toward the outside of the upper outer cover 15 (FIG. 6).

An inner peripheral portion 21*b* is connected to a part of the edge guide 21 protruding toward the outside of the upper outer cover 15, and the edge guide 21 may be slid by the inner peripheral portion 21*b* even when the upper outer cover 15 is closed. That is, when it is proved that a position appropriately guiding the edge of the sheet is not obtained after closing the upper outer cover 15, the edge guide 21 may be operated without opening the upper outer cover 15.

Next, a movable tray 23 is provided at the cassette lower portion (the right side of FIGS. 6 and 7) becoming the downstream in the sheet sending direction, that is, the front end of the sheet in the state where the sheet cassette 11 is attached. The movable tray 23 serves as a so-called hopper, and is specifically adapted to rotate about a pivot point 23*a*. When the movable tray is pivoted by power of a driving mechanism (not shown), a state where the front end of the accommodated sheet P is made to come into press-contact with a feeding roller 37 (described later) (FIG. 5) or a state where the front end of the sheet is separated from the feeding roller (FIG. 4) may be selected.

A plurality of openings 24*a* is formed at a position corresponding to the front end of the sheet in the movable tray 23 at an appropriate interval along the sheet width direction. When the feeding roller 37 is inserted through each of the openings 24*a*, the feeding roller 37 may come into press-contact with the accommodated sheet P. The openings 24*a* constitute an insertion portion of the embodiment.

The reference numeral 12*c* denotes a sheet front end support wall which is formed by the cassette body 12 so as to support the front end of the sheet. In the state where the sheet cassette 11 is attached, the accommodated sheet P is supported while the front end thereof comes into contact with the sheet front end support wall 12*c*.

An opening 27 serving as a "subject recording medium cassette opening" is formed in the sheet front end support wall 12*c* of the cassette body 12 of FIG. 5 so as to open from the side of the feeding roller 37. For this reason, in the state where the front end of the sheet P of FIG. 5 comes into press-contact with the feeding roller 37, the sheet P may be sent to the downstream from the opening 27.

Subsequently, referring to FIGS. 4 and 5, the internal configuration of the ink jet printer 1, particularly the sheet transportation path will be described. In the state where the sheet cassette 11 with the above-described configuration is attached in the vertical direction, the feeding roller 37 serving as the "reversing roller" is provided at a position facing the front end of the sheet cassette 11. A plurality of the feeding rollers 37 is provided in a driving shaft 37*a* extending in the sheet width direction at an appropriate interval in the sheet width direction (FIG. 2), and is driven by a motor (not shown). The feeding rollers send the sheet P to the downstream by rotating while coming into contact with the front end of the sheet.

The sheet P sent downward by the feeding roller 37 is reversed upward by the feeding roller 37 and guide members 40 and 41 disposed to face the outer peripheral surface of the feeding roller 37, and is sent between a transportation driving roller 46 and a transportation driven roller 47 serving as "transportation rollers" (which constitute a sheet transportation unit). That is, a substantially U-shaped transportation path is formed by a "sheet reversing unit" which curves and reverses the sheet P and includes the feeding roller 37 and the guide members 40 and 41. Furthermore, the reference numeral 38 denotes a driven roller that assists the operation of feeding the sheet P using the feeding roller 37.

The transportation driving roller 46 is a roller that is rotationally driven by a motor (not shown). In the embodiment, the roller is formed by attaching wear resistant particles to a surface of a metallic shaft extending in the sheet width direction and corresponds to a weight component in the components of the ink jet printer 1.

In the embodiment, the transportation driven roller 47 is a roller that is formed of a resin material. A plurality of the transportation driven rollers is disposed at an appropriate interval along the axial direction of the transportation driving roller 46, and is provided so as to be biased toward the transportation driving roller 46 by a biasing force of a biasing member (not shown). Then, the transportation driven rollers rotate in a following manner by nipping the sheet P between the transportation driven roller and the transportation driving roller 46.

An ink jet recording head 59 and a guide member 48 are provided at the downstream of the transportation driving roller 46 so as to face each other. The ink jet recording head 59 is provided in a carriage 58, and the carriage 58 is configured to move in a reciprocating manner in the sheet width direction by receiving power from a motor (not shown) while being guided by a carriage guide shaft 55 extending in the sheet width direction.

Furthermore, in the carriage 58, the reference numeral 58*a* denotes a subject guide portion that interposes the carriage guide plate 56 extending in the sheet width direction. That is, the carriage 58 includes a bearing portion that inserts the carriage guide shaft 55 therethrough. However, since the carriage 58 is provided in an inclined posture as shown in the direction, there is a tendency for the carriage to rotate about the carriage guide shaft 55. However, since the subject guide portion 58*a* is configured by interposing the carriage guide plate 56, the rotation tendency is suppressed, so that the posture of the carriage 58 is determined.

Furthermore, as described above, in the embodiment, the ink cartridge 6 is formed as a so-called off-carriage type in which the ink cartridge is provided in the apparatus body, that is, the ink cartridge 6 is provided separately from the carriage 58. However, the invention is not limited thereto, and the ink cartridge 6 may be a so-called on-carriage type in which the ink cartridge is mounted on the carriage 58. Further, in the embodiment, the carriage 58 is configured to perform a recording process while moving in the sheet width direction (a serial printer), but a fixed recording head may be used in which the carriage 58 does not move in the sheet width direction and covers the width of the sheet. Furthermore, the invention is not limited to the ink jet recording type, and other recording types may be used.

Subsequently, the guide member 48 disposed to face the ink jet recording head 59 is formed of a resin material, and defines a gap between the recording surface of the sheet P and the ink jet recording head 59 by supporting the sheet P. Further, a surface facing the ink jet recording head 59 in the guide member 48 is provided with a concave portion (not shown) which receives ink ejected to an area deviated from the end of the sheet during a non-margin printing process, and an ink absorbing martial (not shown) is provided inside the concave portion so as to absorb ink. Then, furthermore, a waste liquid tank (not shown) is disposed below the guide member 48 so as to store ink therein.

The recording unit of the embodiment includes the ink jet recording head 59 that ejects ink while moving in the sheet width direction, the guide member 48 which is disposed so as to face the ink jet recording head 59, and the transportation driving roller 46 and the transportation driven roller 47 which transport the sheet P while nipping the sheet P therebetween, and the recording unit records a text or an image on the sheet P.

Next, a guide roller 49 provided at the downstream of the ink jet recording head 59 prevents the sheet P from being lifted from the guide member 48, and a sheet discharge unit including a discharge driving roller 51 and a discharge driven roller 52 disposed at the downstream of the guide roller 49 discharges the sheet P undergoing the recording process to the outside of the apparatus. Furthermore, in the embodiment, the discharge driving roller 51 is formed as a rubber roller. A plurality of the discharge driving rollers is provided at an appropriate interval in the axial direction of a metallic shaft extending in the sheet width direction, and is rotationally driven by a motor (not shown). Further, each of the guide roller 49 and the discharge driven roller 52 is formed as a toothed roller having a tooth formed at the outer periphery thereof, and rotates in a following manner while coming into contact with the sheet P.

Next, the discharge direction of the sheet P using the discharge driving roller 51 and the discharge driven roller 52 is set to an upward inclined direction facing the sheet cassette 11 in the embodiment, so that the discharged sheet P is discharged to the upside of the apparatus while sliding on the upper outer cover 15 constituting the sheet cassette 11 as shown in FIG. 5. Furthermore, the dashed line of FIG. 5 indicates the passage trace of the sheet P transported by the sheet transportation path.

2. Lock Unit of Movable Tray

Subsequently, the sheet cassette 11, particularly the movable tray 23 and a lock unit 28 serving as a "lock portion" locking the movable tray will be specifically described. As described above, the movable tray 23 serves as a hopper, and is pivotable about the pivot point 23*a* so that a state in which the accommodated sheet bundle comes into press-contact with the feeding roller 37 (a hopper-up state (hereinafter, referred to as an "opened state" of the movable tray 23): the state of FIG. 5) and the state where the sheet bundle is separated from the feeding roller (a hopper-down state (hereinafter, referred to as a "closed state" of the movable tray 23): the state of FIG. 4) may be obtained.

As shown in FIGS. 4 and 6, the movable tray 23 has a configuration in which a support plate 25 as a bottom plate and a cover portion 24 covering the sheet accommodation space are integrally formed with each other, and the support plate 25 serves to press the accommodated sheet bundle toward the feeding roller 37 during the hopper-up operation (FIG. 5). Further, the cover portion 24 serves to return the sheet bundle into the sheet cassette 12 during the hopper-down operation (from FIG. 5 to FIG. 4).

When the movable tray 23 is attached to the apparatus body of the ink jet printer 1, the support plate 25 is configured to engage with a biasing member (not shown). In the cassette attachment state, the movable tray 23 is biased toward the feeding roller 37 at all times by the biasing member. On the other hand, a cam (not shown) is configured to engage with the cover portion 24, and the hopper-down state against the biasing member or the hopper-up state due to the biasing force of the biasing member is obtained through the rotation of the cam.

Here, since the movable tray 23 switches between the opened state in which the accommodated sheet P is able to be supplied and the closed state in which the sheet is stacked in the sheet cassette 11 through the rotation of the movable tray, when the sheet cassette 11 switches to the opened state while being detached from the ink jet printer 1, the accommodated sheet P is inclined from the cassette opening so as to spill out therefrom.

For this reason, the sheet cassette 11 is provided with the lock unit 28 that locks the movable tray 23 in a closed state while being detached from the ink jet printer 1. The lock unit 28 includes a stopper 29 that is provided at both side surfaces of the cassette body 12 and serves as a "lock member" and a biasing member (not shown).

As shown in FIGS. 10A and 10B, the stopper 29 includes a concave portion 29*a* formed at the front end thereof. The concave portion 29*a* engages with a boss portion 26 formed at the side surface of the front end of the movable tray 23, that is, the boss portion 26 enters the concave portion 29*a*, so that the movable tray 23 is locked so as not to pivot from the closed state toward the opened state (the state of FIG. 10A).

Furthermore, the locking/lock releasing operation of the lock unit 28 is automatically performed in accordance with the attachment and detachment operation of the sheet cassette 11 without allowing the user to perform any operation. Specifically, as shown in FIG. 9, a frame 9 disposed on the side of the body of the ink jet printer 1 and forming a space for attaching the sheet cassette 11 is provided with a rib 9*a*.

The rib 9*a* is provided so as to engage with the stopper 29, and the stopper 29 is caught by the rib 9*a* when setting the sheet cassette 11 in the ink jet printer 1 (sliding downward in the vertical direction in a contact state so as to reach a limit). Then, only the body of the sheet cassette 11 advances further toward the contact position, so that the stopper 29 completely switches to the state of FIG. 10B, that is, the lock release position.

Furthermore, since the engagement state between the rib 9*a* and the stopper 29 is released when the sheet cassette 11 is detached, the stopper 29 returns to the locked position again as shown in FIG. 10A. As described above, the locking/lock releasing operation of the lock unit 28 is automatically performed in accordance with the attachment and detachment operation of the sheet cassette 11 without allowing the user perform any operation.

As described above, since the sheet cassette 11 includes the lock unit 28, even when the sheet cassette 11 is detached from the apparatus, the cover portion 23 does not easily switch to the opened state, and the sheet P may be reliably prevented from spilling out from the sheet cassette 11.

Furthermore, the configuration of the lock unit 28 is not limited to the above-described embodiment, and any configuration may be adopted as long as the movable tray 23 may be locked in the closed state when the sheet cassette 11 is detached from the printer apparatus body. Further, in the embodiment, the movable tray 23 is integrally formed with the support plate 25 and the cover portion 24. However, when they are formed as separate members, at least the cover portion 24 may be locked in the closed state (the sheet cassette detachment state).

3. Positioning Unit of Sheet Cassette 11

Next, a method of defining the contact position of the sheet cassette 11 will be described. As shown in FIGS. 8 and 9, a positioning damper 31 is provided at the inner side in the attachment direction of the sheet cassette 11 in the frame 9 forming the accommodation space of the sheet cassette 11. Furthermore, although the positioning damper 31 is provided at a position facing both side surfaces of the sheet cassette 11 in the body of the ink jet printer 1, but they have the same configuration. Accordingly, one positioning damper 31 will be described below.

The positioning damper 31 is formed in a disk shape, and is rotatable about a rotation shaft 31*c*. Then, the outer periphery thereof is provided with concave portions 31*a* and 31*b* and regulation protrusions 31*d* and 31*e*. Furthermore, in FIG. 9, the sheet cassette 11 is removed from the state shown in FIG. 8 in order to show the regulation protrusion 31*d*.

Since a plate spring 32 is fixed to a position facing the outer periphery of the positioning damper 31, the convex portion 32*a* formed in the plate spring 32 is fittable to the concave portions 31*a* and 31*b* formed in the positioning damper 31.

In the state where the sheet cassette 11 is detached from the ink jet printer 1, the concave portion 31*a* of the positioning damper 31 may be fitted to the convex portion 32 (not shown). When the sheet cassette 11 is attached from this state, the front end corner portion 12*d* (see FIGS. 10A and 10B) of the sheet cassette 11 presses the regulation protrusion 31*e* of the positioning damper 31, so that the positioning damper 31 rotates. As a result, the fitting state between the convex portion 32*a* of the plate spring 32 and the concave portion 31*a* of the positioning damper 31 is released, and the convex portion is fitted to the concave portion 31*b* as shown in FIG. 8.

At this time, that is, when releasing the fitting state between the convex portion 32*a* of the plate spring 32 and the concave portion 31*a* of the positioning damper 31, since the spring force of the plate spring 32 is exerted, even when the sheet cassette 11 is strongly attached, the force is reduced. Accordingly, the member is not damaged when setting the sheet cassette 11, the sound of a collision is prevented from being generated, and the accommodated sheet is prevented from flying outward due to impact.

Further, since the front end corner portion 12*d* of the sheet cassette 11 is interposed between the regulation protrusions 31*d* and 31*e* in the state where the sheet cassette 11 is attached, the sheet cassette 11 is prevented from easily moving from the attachment position. Furthermore, when the sheet cassette 11 is detached, the front end corner portion 12*d* of the sheet cassette 11 comes into contact with the regulation protrusion 31*d*, and the positioning damper 31 rotates, thereby completely switching from the fitted state between the concave portion 31*b* and the convex portion 32*a* (the plate spring 32) to the fitted state between the concave portion 31*a* and the convex portion 32*a*.

Furthermore, in the state where the sheet cassette 11 is attached, since the regulation protrusion 31*e* of the positioning damper 31 defines the contact position of the sheet cassette 11, that is, the positioning damper 31 may serve as an impact reducing unit and a positioning unit when attaching the sheet cassette, the number of components may be decreased.

4. Blocking Unit of Movable Tray and Others

Subsequently, a method of blocking the movable tray 23 will be described. In the state where the sheet cassette 11 is attached, a hopper-up/down operation is performed by a driving mechanism (not shown) as described by referring to FIGS. 4 and 5.

Here, if the sheet cassette 11 is extracted in the hopper-up state (FIG. 5), there is a concern in that the accommodated sheet may spill out. Therefore, in the ink jet printer 1, a return roller 35 is provided at a position facing the upper cover 24 of the movable tray 23.

The return roller 35 is provided near both side ends of the upper cover 24 in the x direction, and is provided near the pivot point 23*a* of the movable tray 23 in the z direction in the state where the sheet cassette 11 is attached. Then, if the movable tray 23 is extracted upward while being opened (the state of FIG. 5), the movable tray 23 is pressed by the return roller 35 in the closed state as shown in the change from FIG. 11 to FIG. 12. Accordingly, the movable tray 23 is not extracted in the opened state, and it is possible to prevent a problem in which the accommodated sheet spills out.

Furthermore, in the above-described relation with the lock unit 28, when the sheet cassette 11 is detached from the state of the attachment to the apparatus body, if the stopper 29 completely switches from the lock release position (FIG. 10B) to the locked position (FIG. 10A) before returning to the state where the movable tray 23 is completely closed, the lock unit 28 is not operated normally, and the movable tray 23 may not be locked in the closed state. Accordingly, it is desirable to set the displacement timing of the stopper 29 (in the embodiment, the timing depends on the position of the rib 9*a* (FIG. 9) in the z direction) so that the above-described problem does not arise.

Subsequently, referring to FIGS. 13A and 13B, another embodiment of the movable tray 23 will be described. FIG. 13A illustrates a sheet feeding state when switching from the hopper-up state to the hopper-down state, and the reference numeral P1 denotes the sheet to be fed. The hopper-down operation is performed after the rear end of the sheet P1 which is being fed exits the sheet cassette 11. However, when the hopper-down operation is performed in the state where the next sheet is supplied from the sheet cassette 11 by a predetermined amount by being guided by the sheet P1 which is being fed, the sheet is interposed between the front end of the movable tray (the front end of the cover portion 24) and the guide member 40 (the position depicted by the arrow Q), so that there is a concern in that the front end of the sheet may be bent.

Therefore, as another embodiment of the movable tray 23, the front end of the cover portion 24 may be made movable. In FIG. 13, the reference numeral 24' denotes a cover portion according to another embodiment, and the front end 24*c* of the cover portion 24' is pivotable about the pivot point 24*b* in a free state. Furthermore, it is desirable that the length of the front end 24*c* (the length of the z direction) be set to a length in which the sheet may be returned to the inside of the sheet cassette without any problem during the hopper-down operation.

When the front end of the cover portion is formed in this manner, even when the hopper-down operation is performed from the state where a predetermined amount of the sheet is supplied from the sheet cassette 11 as shown in FIG. 13B, it is possible to prevent the sheet from being interposed and bent between the front end 24*c* and the guide member 40 due to the rotation of the front end 24*c*.

Furthermore, in addition to the embodiment shown in FIGS. 13A and 13B, for example, even when the portion corresponding to the front end 24*c* is removed (is formed as an opening) and the front end of the sheet is inserted into the sheet cassette by a biasing member, the above-described sheet interposing may be prevented.

Second Embodiment

Hereinafter, referring to the accompanying drawings, a recording apparatus according to a second embodiment will be described. The recording apparatus performs a desired recording process while transporting a sheet (a recording medium) held in an upright posture and holds (stocks) the sheet having an image formed thereon in an upright posture. Furthermore, the following description will be made by defining the X direction (the horizontal direction), the Y direction (the longitudinal direction), and the Z direction (the vertical direction) as shown in the respective drawings.

In the first embodiment, a configuration has described in which the lock portion is provided so as to lock the movable portion in the closed state. However, in the second embodiment, a configuration will be described in which a forward moving mechanism and a backward moving mechanism are provided so as to move the movable portion and a power transmission mechanism is provided so as to transmit power to the backward moving mechanism.

Figure 14:
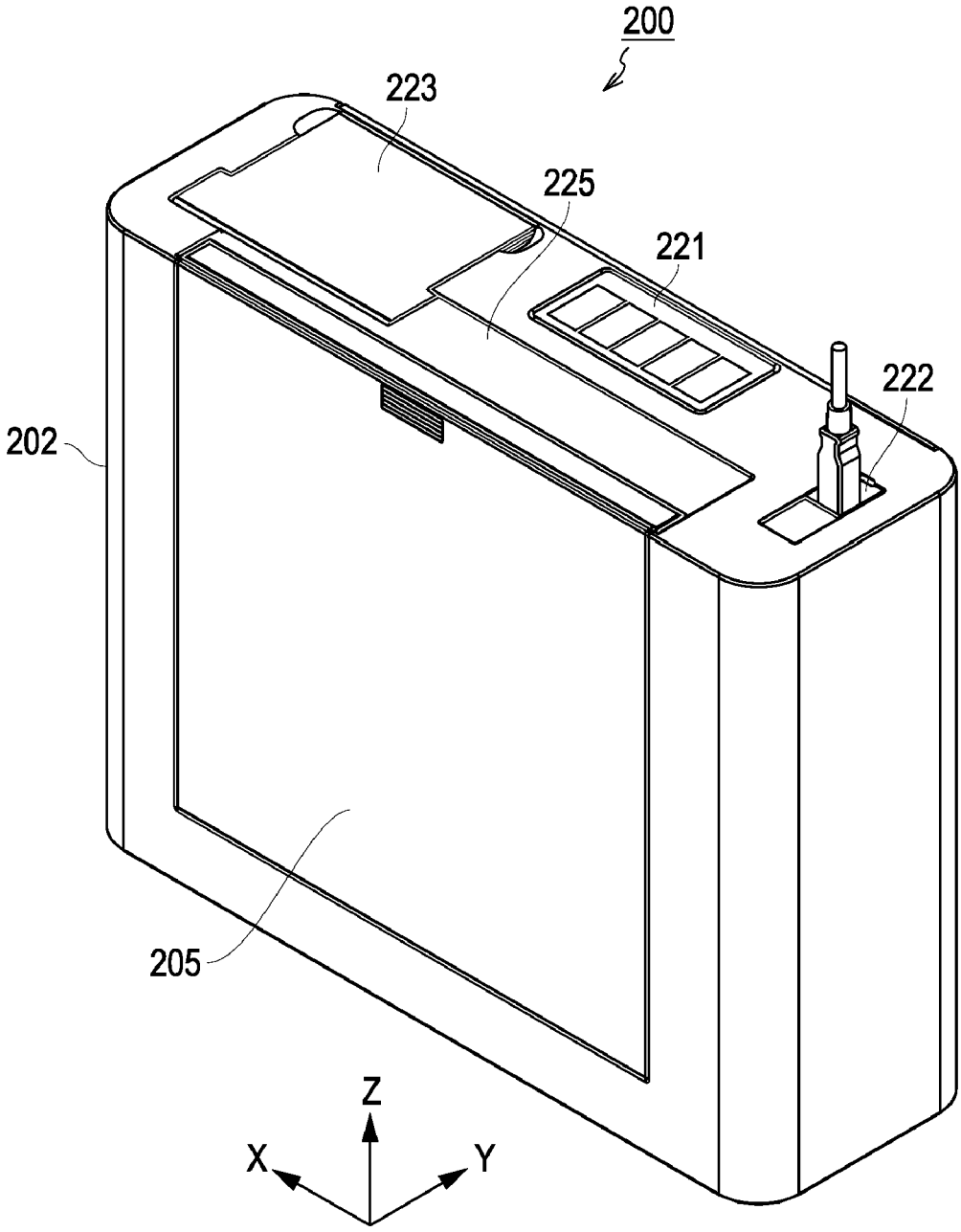
FIG. 14 is an external perspective view illustrating a recording apparatus of a second embodiment.
Figure 15:
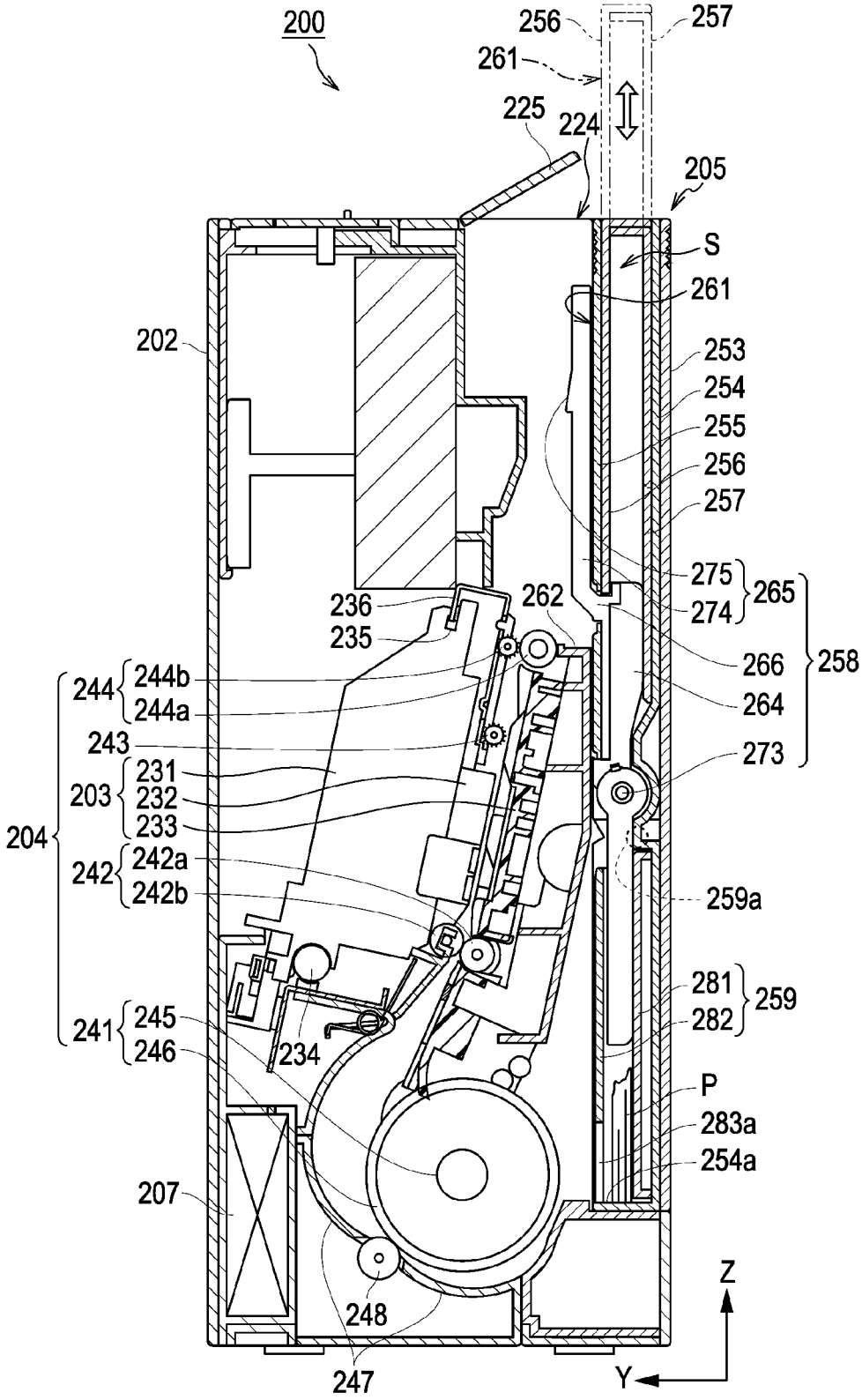
FIG. 15 is a side cross-sectional view illustrating the recording apparatus in the state where a sheet is separated from a feeding roller.
Figure 16:
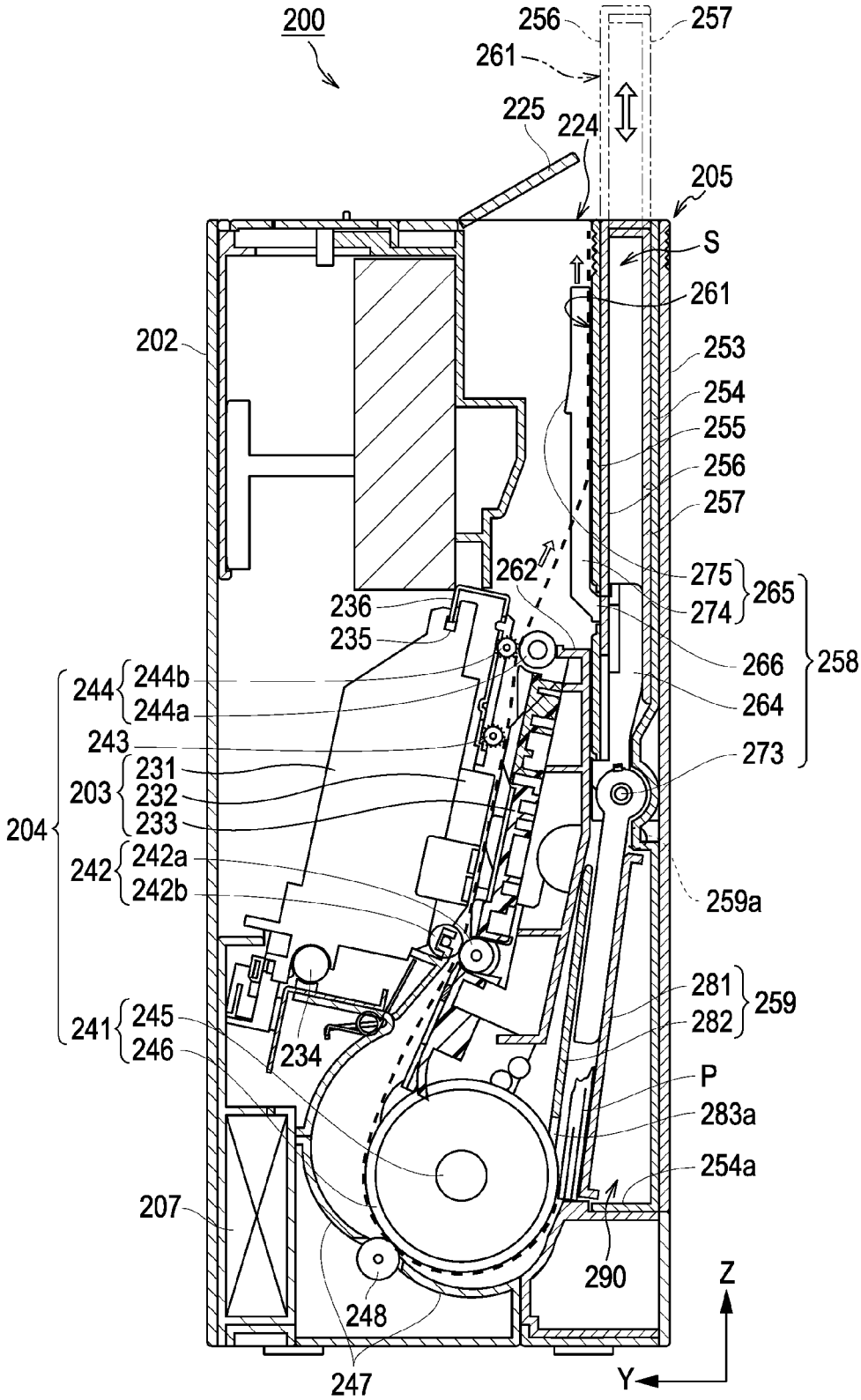
FIG. 16 is a side cross-sectional view illustrating the recording apparatus in the state where the sheet is made to come into press-contact with the feeding roller.

As shown in FIGS. 14 to 16, the appearance of a recording apparatus 200 is formed by a casing 202 which is formed in a thin box shape of which the dimensions in the Z direction is larger than the dimensions in the X and Y directions. Furthermore, the so-called vertical installation-type recording apparatus 200 is formed so that the installation area becomes smaller by decreasing the dimensions in the X and Y directions. Further, since the dimensions in the X direction are determined by the maximal width of the sheet P to be used, the installation area is suppressed by suppressing the dimensions in the Y direction.

Further, the recording apparatus 200 includes a recording unit 203 that performs a recording process on the sheet P disposed on the transportation path through an ink jet type, a transportation unit 204 that sends the sheet P along the transportation path, a recording medium cassette 205 that accommodates the sheet P in an upright posture and is attachably and detachably attached to the casing 202, a moving unit 206 (see FIG. 21) that moves a movable tray 259 (to be described later) of the recording medium cassette 205, an apparatus frame (not shown) that supports the transportation unit 204, the recording unit 203, the moving unit 206, and the like, and a control device 207 that controls the entire apparatus.

The top surface of the casing 202 is provided with a manipulation panel 221 that has manipulation buttons, a cable terminal 222 to which a cable used for the connection to a PC or the like is connected, and a cartridge cover 223 that opens or closes a cartridge attachment portion (not shown) having a plurality of ink cartridges (not shown) attachably and detachably attached thereto. Further, the top surface of the casing 202 is provided with a sheet discharge port cover 225 that opens or closes the sheet discharge port 224 for discharging the sheet P (the recording medium) having an image formed thereon. Furthermore, the sheet discharge port cover 225 is opened or closed by the user, but is automatically opened by an opening and closing mechanism (not shown) even when the recording process is performed in a closed state.

The recording unit 203 is disposed at the downstream of a pair of transportation rollers 242 to be described later, and includes a carriage 231 that has an ink jet head 232 mounted thereon and a guide member 233 that is provided at a position facing the ink jet head 232.

The carriage 231 is provided so as to reciprocate by using a motor (not shown) along a carriage guide shaft 234 extending in the X direction. Furthermore, as shown in FIG. 15, since the carriage 231 is formed in an inclined posture, a force is generated for rotating about the carriage guide shaft 234. Therefore, a subject guide portion 235 provided above the carriage 231 maintains the posture of the carriage 231 to be constant by interposing a carriage guide plate 236 extending in the X direction.

The guide member 233 constitutes a part of the transportation path, and defines a gap (a work gap) between the recording surface of the sheet P and the ink jet head 232. Further, the guide member 233 is provided with a concave portion which receives ink ejected to an area deviated from the end of the sheet P when performing a non-margin recording process at a position facing the ink jet head 232. An ink absorbing material (not shown) is provided inside the concave portion so as to absorb ink. Then, furthermore, a waste liquid tank (not shown) is disposed below the guide member 233 so as to store ink therein.

Furthermore, in the embodiment, a so-called off-carriage type is described in which the ink cartridge is provided separately from the carriage 231, but a so-called on-carriage type may be adopted in which the ink cartridge is mounted on the carriage 231. Further, in the embodiment, a so-called serial printer is described which performs a recording process by moving the carriage 231 in the X direction, but a fixed ink jet head may be used which covers the width of the sheet P. Furthermore, the invention is not limited to the ink jet type, and other recording types may be used.

The transportation unit 204 is disposed at a position facing the front end of the recording medium cassette 205 attached in the upstream, and includes a feeding roller 241 which sends the sheet P supplied from the recording medium cassette 205 to the downstream, a pair of transportation rollers 242 which transports the sheet P to the recording unit 203, a guide roller 243 which prevents the sheet P from being lifted from the guide member 233 of the recording unit 203, and a pair of sheet discharge rollers 244 which discharges the sheet P having an image formed thereon from the recording unit 203.

The feeding roller 241 includes a roller shaft 245 which extends in the X direction and a plurality of roller bodies 246 which is attached to the roller shaft 245 at an appropriate interval. A motor (with a speed reduction mechanism) (not shown) is connected to one end of the roller shaft 245. Each roller body 246 sends the sheet P downward by the rotation using a driving force of the motor while coming into contact with the front end of the sheet P. In a position facing the outer peripheral surface of the feeding roller 241, a guide member 247 is disposed so as to form a substantially U-shaped transportation path which curves and reverses the sheet P. Furthermore, the reference numeral 248 denotes an auxiliary driven roller that assists an operation of sending the sheet P using each roller body 246. That is, each roller body 246 and each auxiliary driven roller 248 are used in the form of nip rollers.

Each of the pair of transportation rollers 242 includes a transportation driving roller 242*a* which is rotationally driven by a driving motor (not shown) and a transportation driven roller 242*b* which is biased toward the transportation driving roller 242*a* by a biasing member (not shown), and is used in the form of a nip roller. The transportation driven roller 242*b* rotates in a following manner by nipping the sheet P between the transportation driven roller and the transportation driving roller 242*a*. Furthermore, although not shown in the drawings, the pair of transportation rollers 242, the guide roller 243, and the pair of sheet discharge rollers 244 are formed as a plurality of rotation rollers attached to a rotation shaft extending in the X direction as in the above-described feeding roller 241.

The pair of sheet discharge rollers 244 includes a sheet discharge driving roller 244*a* which is rotationally driven by a driving motor (not shown) and a sheet discharge driven roller 244*b* which is biased toward the sheet discharge driving roller 244*a* by a biasing member (not shown). The surface of the sheet discharge driving roller 244*a* is formed of rubber or the like. The sheet discharge driven roller 244*b* is formed in a spur shape (a star wheel), and rotates in a following manner by nipping the sheet P between the sheet discharge driven roller and the sheet discharge driving roller 244*a*.

The sheet P sent downward is reversed upward by the feeding roller 241 and the guide member 247 and is sent to the pair of transportation rollers 242. The sheet P is sent to the recording unit 203 while being nipped between the pair of transportation roller 242. The sheet P having an image formed thereon in the recording unit 203 moves while sliding on a holding surface 261 (to be described later) of the recording medium cassette 205 through the guide roller 243 and the pair of sheet discharge rollers 244 (see the dashed line of FIG. 16). The lower end of the discharged sheet P is supported in an upright posture by the accommodation portion 262 provided in the apparatus frame near the sheet discharge driving roller 244*a*. Furthermore, the guide roller 243 is formed as a spur roller (star wheel).

The front end of the accommodation portion 262 near the sheet discharge driving roller 244*a* is bent upward, so that the lower end of the supported sheet P does not drop or does not come into contact with the sheet discharge driving roller 244*a*. Further, a plurality of the accommodation portions 262 is disposed at an appropriate interval in the X direction so as to enter between a plurality of sheet discharge driving rollers 244*a* disposed at an appropriate interval. That is, the accommodation portions 262 are substantially formed in a comb-like shape as a whole.

Subsequently, referring to FIGS. 15 to 20B, the recording medium cassette 205 will be described. The recording medium cassette 205 is formed to be attachable to or detachable from by sliding in the Z direction with respect to the casing 202, and forms the appearance of the recording apparatus 200 when being attached thereto. Further, since the inside of the recording apparatus 200 is exposed by detaching the recording medium cassette 205, it is possible to easily solve a problem in which the sheet P is jammed in the transportation path.

The recording medium cassette 205 includes a cassette casing 253 which is flush with the casing 202 in an attachment state and forms an appearance of the recording apparatus 200, a body tray 254 which serves as a "subject recording medium cassette body" and is formed in a tray shape as a whole, an upper outer cover 255 which opens or closes the sheet accommodation space S accommodating the sheet P, an upper inner cover 256 which is slidable so as to protrude from the front end of the body tray 254 with respect to the upper outer cover 255, an upper slide tray 257 which is slidable so as to protrude from the upper end of the body tray 254 with respect to the body tray 254, an edge guide 258 which is slidable in the X direction with respect to the upper outer cover 255, and a movable tray 259 which swings the front end of the sheet P accommodated in the sheet accommodation space S.

The lower end of the body tray 254 of FIG. 15 is provided with a sheet front end support wall 254*a* which supports the front end of the accommodated sheet P. In FIG. 16, the body tray 254 near the sheet front end support wall 254*c* is provided with an opening 290 which serves as a "subject recording medium cassette opening" opened from the feeding roller 241. For this reason, in the state where the recording medium cassette 205 of FIG. 15 is attached, the front end of the accommodated sheet P is supported while coming into contact with the sheet front end support wall 254*a*. Further, the sheet front end support wall 254*a* is provided with a plurality of lever insertion portions 254*b* (three in FIG. 17) which is notched at the side of the feeding roller 241 so that the sheet returning levers 287 are inserted therethrough.

The upper outer cover 255 is rotatable about a pair of left and right rotation points 255*a* (see FIGS. 17 to 19) substantially provided at the center in the vertical direction of the body tray 254. When the upper outer cover 255 is opened, the sheet accommodation space S is exposed, so that the sheet P may be accommodated. Further, the outer surface (the surface facing the inside the apparatus when attaching the outer cover) of the upper outer cover 255 serves as the holding surface 261 used to hold (store) the sheet P having an image formed thereon.

As shown in FIGS. 15 and 16, when the upper inner cover 256 slides with respect to the upper outer cover 255 and the upper slide tray 257 slides with respect to the body tray 254, the sheet accommodation space S may be expanded or contracted in accordance with the length of the sheet P in the Z direction. Further, when the upper inner cover 256 is expanded, the outer surface of the upper inner cover 256 extends so as to be continuous to the outer surface of the upper outer cover 255, and the holding surface 261 extends in the Z direction.

As shown in FIGS. 15 to 19, the edge guide 258 includes a supply-side guide 264 which guides the accommodated sheet P to the sheet accommodation space S, a discharge-side guide 265 which guides the sheet P held by the holding surface 261, and a connection portion 266 which connects the supply-side guide 264 and the discharge-side guide 265 to each other through an elongated hole 255*b* formed to penetrate the upper outer cover 255.

Figure 19:
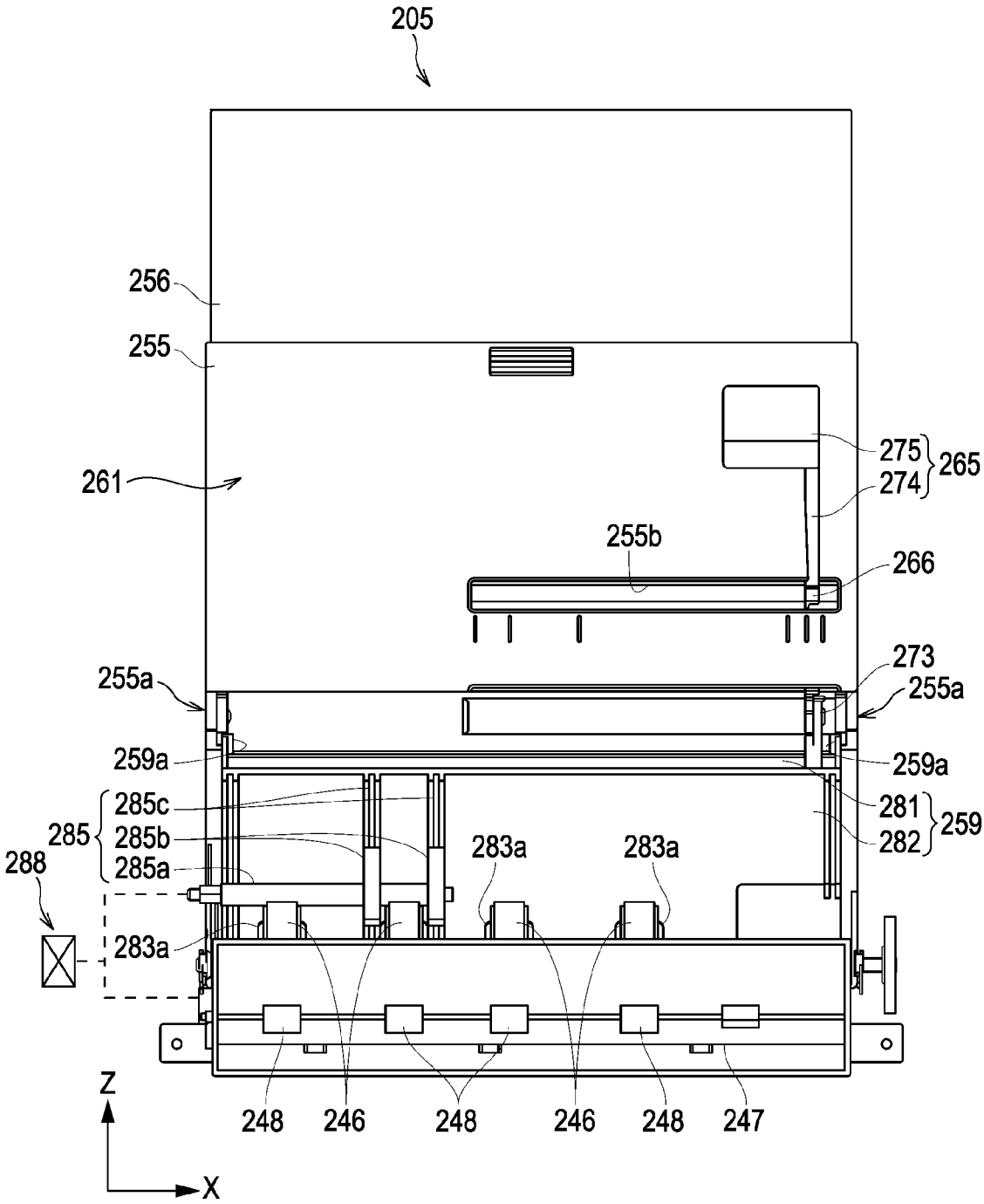
Figure 20A:
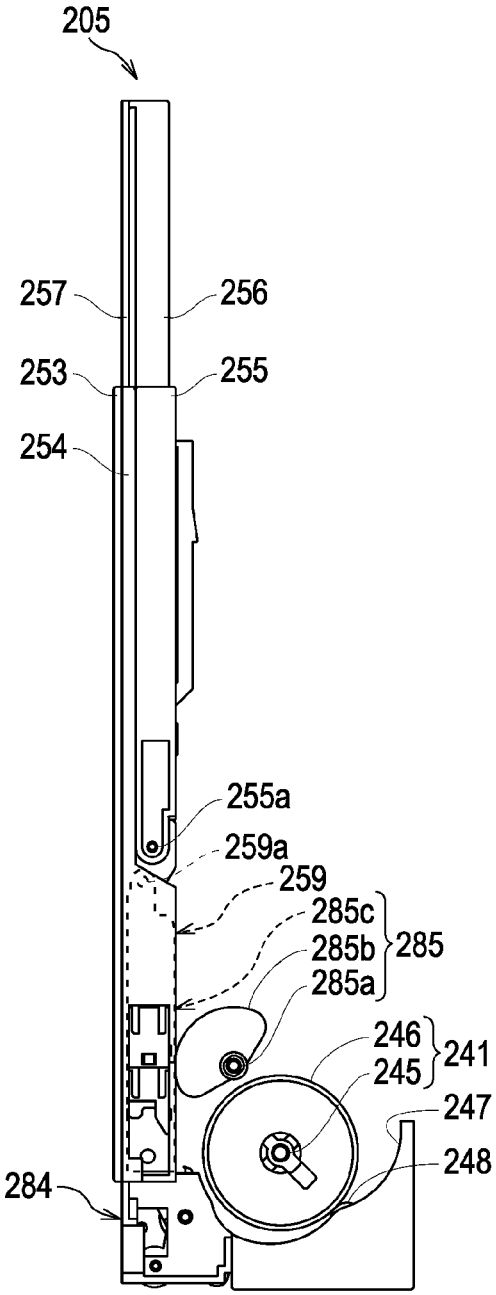
Figure 20B:
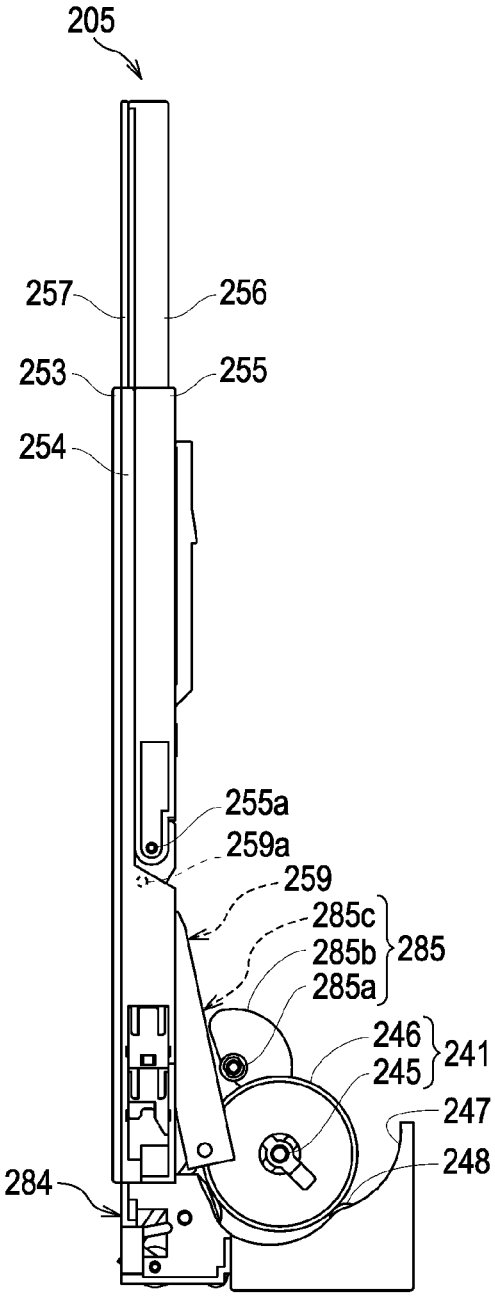

The edge guide 258 is slidable along the elongated hole 255*b* at the portion of the connection portion 266, and guides the movement of the sheet P in the transportation direction (the Z direction) while coming into contact with the end of the sheet P from the right side of FIG. 19. Accordingly, the sheet P is set in the sheet accommodation space S while being arranged in the width direction, and is normally transported without any deviation in the width direction.

The supply-side guide 264 is provided with a guide rotation point 273 coaxial with the pair of left and right rotation points 255*a*. Accordingly, the supply-side guide 264 above the guide rotation point 273 rotates along with the upper outer cover 255. Further, the pair of left and right pivot points 259*a* is provided while being slightly deviated from the downside and the rear side of the rotation point 255*a* and the guide rotation point 273 (see FIGS. 15 and 16). Accordingly, the supply-side guide 264 below the guide rotation point 273 is rotatable along with the movable tray 259.

The discharge-side guide 265 is provided in the holding surface 261, and includes a guide bar 274 which extends upward from the connection portion 266 and a plate-like portion 275 which is connected to the upper end of the guide bar 274. The plate-like portion 275 is provided so as to be disposed from the right side of the discharged sheet P in FIG. 19. Further, in the guide bar 274 and the plate-like portion 275, the user corresponds to an operator who performs the slide operation of the edge guide 258.

In the embodiment, when any one of the supply-side guide 264 and the discharge-side guide 265 connected at the connection portion 266 is displaced, the other is also displaced at the same time. Accordingly, the edge guide 258 may be slid while the sheet accommodation space S is blocked by the upper outer cover 255.

Figure 17:
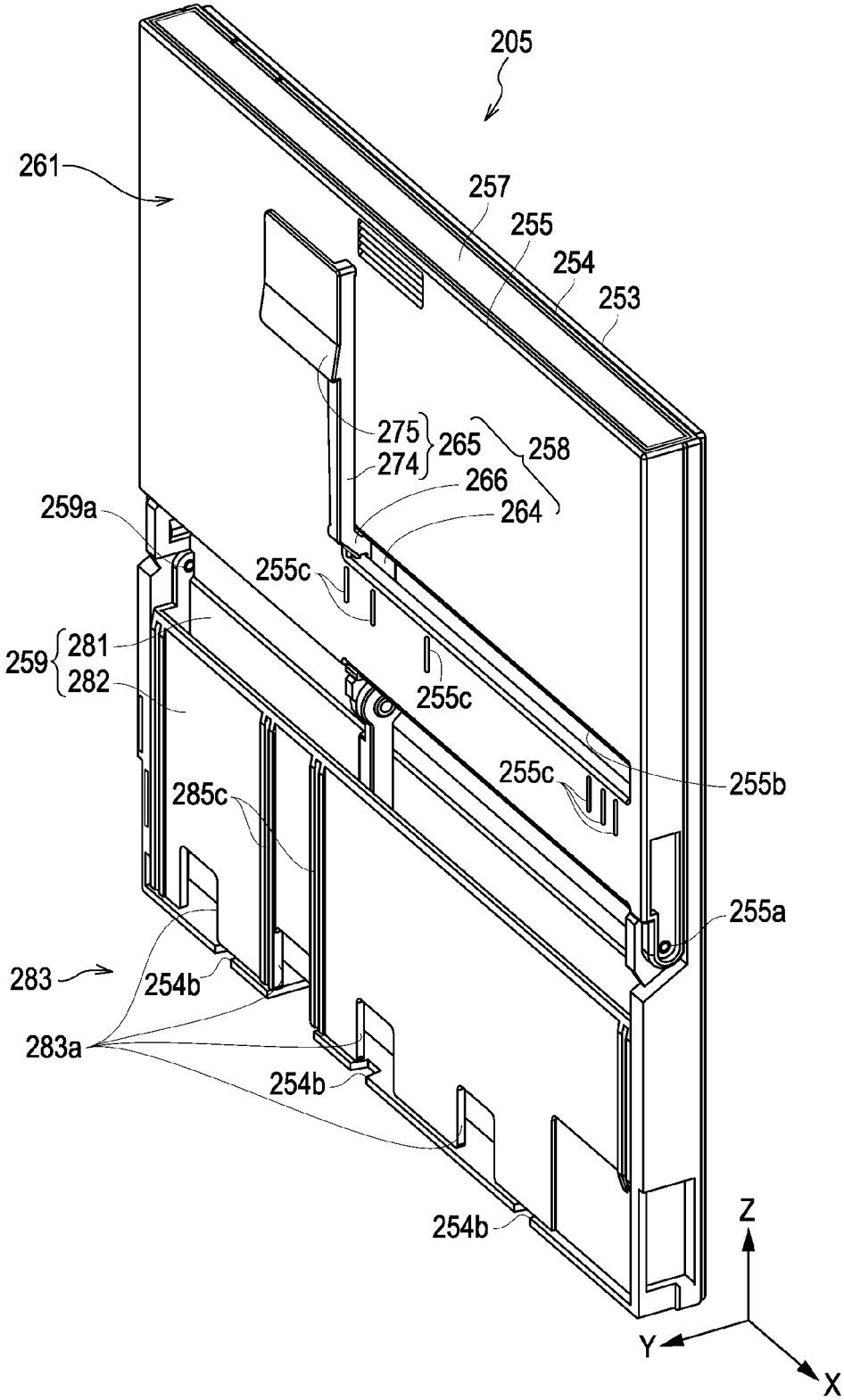
FIG. 17 is a perspective view illustrating a recording medium cassette in the state where an upper outer cover is blocked.
Figure 18:
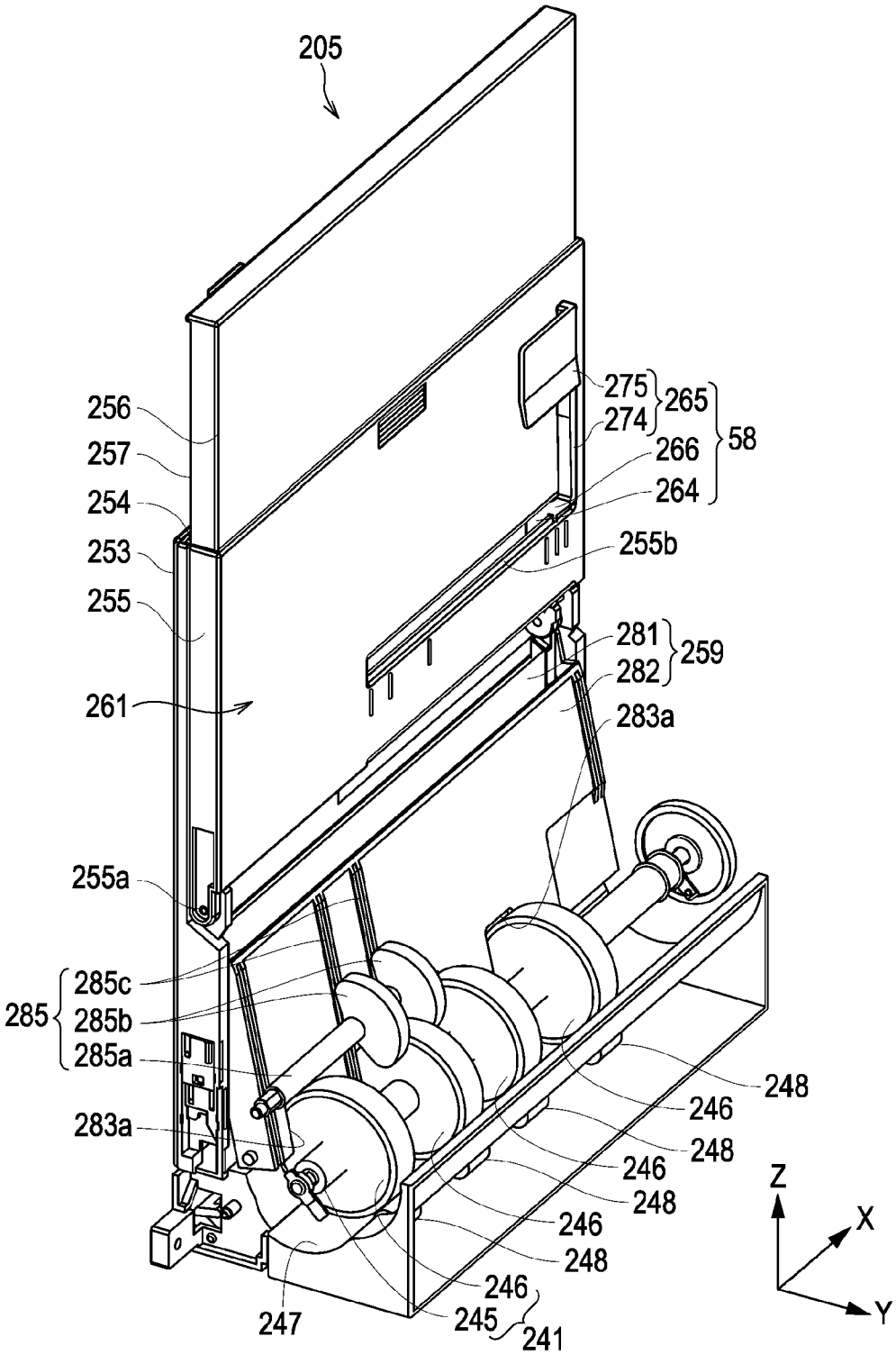

Furthermore, as shown in FIG. 17, scale markings 255*c* indicating the corner in the X direction of the sheet P corresponding to A4 size according to, for example, JIS standards is provided near the lower side of the elongated hole 255*b* of the upper outer cover 255.

The movable tray 259 serving as the "movable portion" is integrally formed with a base casing 281 accommodating the sheet P and a cover casing 282 provided to cover the accommodated sheet P. Further, the movable tray 259 is supported so as to be rotatable about the pair of left and right pivot points 259*a* (see FIGS. 17 and 19) with respect to the body tray 254. That is, the movable tray 259 serves as a so-called hopper, and rotates about each pivot point 259*a* by driving a moving unit 206 to be described later, so that the front end of the sheet P swings between the contact position (see FIG. 16) and the separation position (see FIG. 15).

In the contact position of the movable tray of FIG. 16, the sheet P may be sent to the downstream from the opening 290.

Further, as shown in FIG. 17, the cover casing 282 is provided with a contact insertion portion 283 which serves as an "insertion portion" and is provided at a position corresponding to the front end of the sheet P so as to insert the feeding roller 241 therethrough and come into press-contact with the sheet P. The contact insertion portion 283 includes a plurality of partial insertion portions 283*a* provided at the positions corresponding to the plurality of roller bodies 246 included in the feeding roller 241. That is, the plurality of partial insertion portions 283*a* is formed at an appropriate interval in the X direction. For this reason, the sheet P accommodated in the sheet accommodation space S in an upright posture is supported by the inner surface of the cover casing 282 without the plurality of partial insertion portions 283*a*. Accordingly, it is possible to reliably prevent the sheet P accommodated in the sheet accommodation space S in the upright posture from spilling out therefrom. Further, since the movable tray 259 is moved to the contact position, the plurality of roller bodies 246 ensuring the appropriate transportation of the sheet P are respectively inserted through the partial insertion portions 283*a* so as to appropriately come into rolling-contact with the sheet P. Accordingly, it is possible to reliably transport the sheet P using the feeding roller 241 and reliably maintain the sheet P in the upright posture inside the sheet accommodation space S.

Next, referring to FIGS. 17 to 21E, a moving unit 206 will be described. The moving unit 206 moves the movable tray 259 between a contact position in which the sheet P accommodated in the movable tray 259 contacts (comes into press-contact with) the feeding roller 241 and a separation position in which the sheet is separated therefrom.

The moving unit 206 includes a forward moving mechanism 284 which biases the movable tray 259 so as to move from the separation position to the contact position, a backward moving mechanism 285 which moves the movable tray 259 from the contact position to the separation position against the biasing force of the forward moving mechanism 284, a nip mechanism 286 which supplies the sheet P by nipping the sheet between the nip mechanism and the feeding roller 241, a plurality of sheet returning levers 287 which returns the sheet P subsequent to the sheet P being supplied into the movable tray 259, and a power transmission mechanism 288 which transmits a driving force from a motor (not shown) to the backward moving mechanism 285 at a timing in which the sheet P is supplied one by one.

As shown in FIGS. 20A to 21E, the forward moving mechanism 284 includes a pressing arm 284*b* of which a base end is rotatably journaled to a pressing support shaft 284*a* and a front end comes into contact with the base casing 281 and a torsional spring 284*c* which rotationally biases the pressing arm 284*b* and serves as a "spring".

The front end of the pressing arm 284*b* engages with the lower end of the rear surface of the base casing 281 (the surface near the body tray 254). The torsional spring 284*c* is provided so as to be fitted to the pressing support shaft 284*a*, and biases the pressing arm 284*b* from the separation position toward the contact position. Accordingly, the movable tray 259 is biased from the separation position toward the contact position by the biasing force of the torsional spring 284*c* through the pressing arm 284*b*.

As shown in FIGS. 18 to 20B, the backward moving mechanism 285 includes a cam shaft 285*a* which extends in the X direction from the side of the movable tray 259 and the upside of the feeding roller 241 and two plate cams 285*b* which are attached to the cam shaft 285*a*.

The respective plate cams 285*b* are coated on the cam shaft 285*a* at a predetermined interval in the same direction. The respective plate cams 285*b* come into contact with a pair of rail-shaped cam followers 285*c* provided in the cover casing 282 so as to extend in the Z direction. When the respective plate cams 285*b* are rotated while not coming into contact with the respective cam followers 285*c*, the movable tray 259 moves to the contact position due to the biasing force of the forward moving mechanism 284. On the other hand, when the respective plate cams 285*b* are rotated so as to come into contact with the respective cam followers 285*c* and to press-insert the movable tray 259, the movable tray 259 moves to the separation position against the biasing force of the forward moving mechanism 284.

As shown in FIGS. 21A to 21E, the nip mechanism 286 includes a retard roller 286*a* which comes into contact with the roller body 246 of the feeding roller 241 from the side of the movable tray 259 and the downside so as to rotate in a following manner and a retard frame 286*b* which journals a retard roller 286*a*. The base end of the retard frame 286*b* is rotatably journaled to the retard support shaft 286*c*. The retard roller 286*a* comes into rolling-contact with the roller body 246 by rotating the retard frame 286*b* about the retard support shaft 286*c*. One sheet P is transported to the downstream by being nipped between the retard roller 286*a* and the roller body 246.

As shown in FIGS. 21A to 21E, the base ends of respective sheet returning levers 287 are rotatably journaled to the pressing support shaft 284*a*. The respective sheet returning levers 287 are disposed so that the front ends are disposed in the lever insertion portions 254*b* notched in the sheet front end support wall 254*a*. The front ends of the sheet returning levers 287 are notched so as to contact the lower end of the sheet P from the side of the contact position.

Here, when the plurality of sheets P is accommodated in the sheet accommodation space S, the sheet P subsequent to one sheet P (the sheet P coming into contact with the feeding roller 241) is also extracted from the nip point between the retard roller 286*a* and the roller body 246.

However, although it will be described in detail, the subsequent sheet P extracted from the nip point may be appropriately returned to the sheet accommodation space S since the respective sheet returning levers 287 move to the separation position together with the movable tray 259 moving to the separation position.

As shown in FIG. 19, the power transmission mechanism 288 includes a motor and a speed reduction gear set (not shown), and rotates the pressing support shaft 284*a*, the cam shaft 285*a*, and the retard support shaft 286*c* connected to the output end of the speed reduction gear set. Accordingly, the respective sheet returning lever 287, the respective plate cams 285*b*, and the retard frame 286*b* (the retard roller 286*a*) rotate in a predetermined rotation direction by a necessary amount (angle). Furthermore, the power transmission mechanism 288 includes a cam (not shown) which prohibits the rotation of the pressing arm 284*b* toward the contact position. The cam prohibits the rotation of the pressing arm 284*b* even when the recording medium cassette 205 is detached.

Next, referring to FIGS. 21A to 21E, an operation of the movable tray 259 and the moving unit 206 will be described. First, in the state where the recording apparatus 200 is stopped, the movable tray 259 is present at the separation position (see FIG. 21A). When there is a recording (printing) command from the user, a control device 207 drives the power transmission mechanism 288 so as to rotate the respective plate cams 285*b* in a direction moving away from the respective cam followers 285*c* (see FIG. 21B). At this time, the respective sheet returning levers 287 start to rotate toward the feeding roller 241.

Figures 21A, 21B, 21C, 21D, 21E:
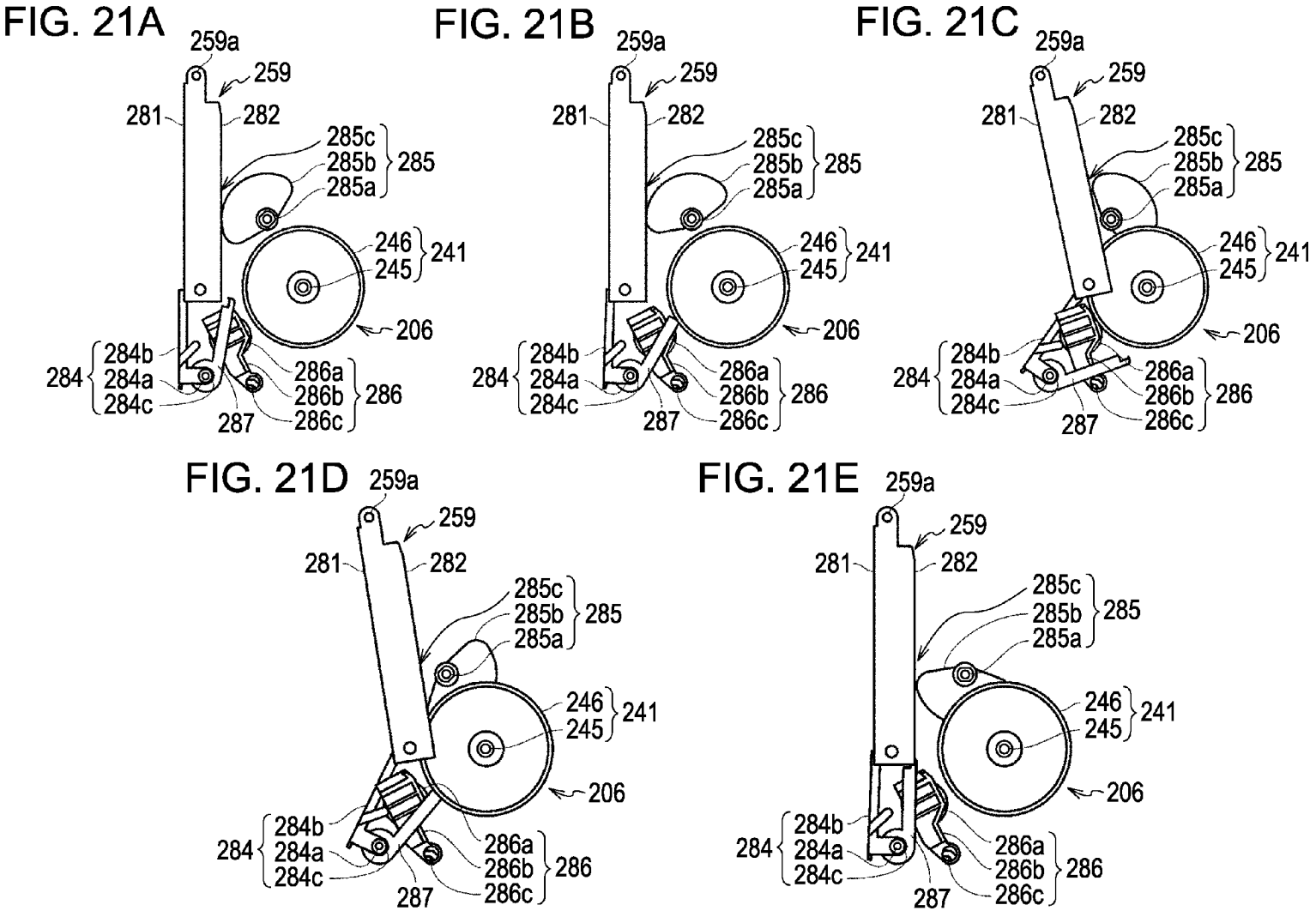
FIGS. 21A to 21E are diagrams illustrating an operation of a movable tray and a moving unit.

Furthermore, when the respective plate cams 285*b* are rotated, the respective plate cams 285*b* are separated from the respective cam followers 285*c*, and are pressed by the pressing arm 284*b* to which the biasing force of the torsional spring 284*c* is exerted, so that the movable tray 259 rotates toward the contact position (see FIG. 21C). At this time, the retard roller 286*a* comes into rolling-contact with the downside of the roller body 246 (the feeding roller 241) in the inclined direction. Further, the respective sheet returning levers 287 rotate to a position where the feeding of the sheet P is not disturbed. The accommodated sheet P inside the movable tray 259 comes into contact with the feeding roller 241 (the respective roller body 246) through the contact insertion portion 283 (the respective partial insertion portion 283*a*). One contacted sheet P is discharged in the rotation direction of the feeding roller 241, and is supplied to the transportation path by being nipped (at the nip point) between the retard roller 286*a* and the roller body 246.

When the power transmission mechanism 288 is continuously driven so that the respective plate cams 285*b* rotate further, the respective plate cams 285*b* come into contact with the respective cam follower 285*c* again (see FIG. 21D). Here, when the first sheet P is completely supplied and transported, the second sheet P comes into contact with the feeding roller 241.

However, in the moving unit 206, when the supplied sheet P is transported to a position between the pair of transportation rollers 242, the retard roller 286*a* rotates in a direction moving away from the roller body 246. Also, the respective sheet returning levers 287 rotate toward the movable tray 259, and the front end thereof catches the second sheet P at the nip point so as to press-insert the sheet into the movable tray 259.

When the respective plate cams 285*b* further rotate, the respective plate cams 285*b* returns the pressing arm 284*b* and the movable tray 259 toward the separation position against the biasing force of the torsional spring 284*c*, and the respective sheet returning levers 287 press-insert the second sheet P into the movable tray 259 (see FIG. 21E). Then, the movable tray 259 returns to the state (the separation position) before starting the recording (printing) process (see FIG. 21A).

According to the above-described configuration, it is possible to transport the sheet P and perform an appropriate recording (printing) process while appropriately preventing the sheet P accommodated in the upright posture from a portion opened for the access to the feeding roller 241. Further, even when a plurality of sheets P is accommodated in the movable tray 259 (the sheet accommodation space S), one sheet P coming into contact with the feeding roller 241 at the contact position may be reliably transported using the power transmission mechanism 288.

The above-described embodiments are merely an example, and it is needless to say that the invention is not limited thereto. For example, in the first embodiment and the second embodiment, the sheet cassette 11 according to the invention is applied to the vertical installation-type ink jet printer, but the invention is not limited thereto. That is, the invention may be applied to a recording apparatus with a sheet cassette in which the sheet is set in the vertical direction or the inclined direction when the sheet cassette is attached to the apparatus. Further, in the first embodiment and the second embodiment, the invention is applied to the ink jet printer which is an example of the recording apparatus, but may be generally applied to a liquid ejecting apparatus.

Here, the liquid ejecting apparatus is not limited to a recording apparatus such as a printer, a copying machine, and a facsimile using an ink jet recording head and performing a recording process on a subject recording medium by ejecting ink from the recording head, and also includes an apparatus that ejects a liquid corresponding to the purpose instead of ink from a liquid ejecting head corresponding to the ink jet recording head to a subject ejecting medium corresponding to the subject recording medium so as to attach the liquid to the subject ejecting medium.

As the liquid ejecting head, a color material ejecting head used to manufacture a color filter of a liquid display or the like, an electrode material (conductive paste) ejecting head used to form an electrode of an organic EL display or a field emission display (FED), a biological organic material ejecting head used to manufacture a biochip, a sample ejecting head used as a precision pipette, and the like may be exemplified in addition to the recording head.

The entire disclosures of Japanese Patent Applications No. 2010-226382, filed Oct. 6, 2010, and No. 2011-032930, filed Feb. 18, 2011, are expressly incorporated by reference herein.

What is claimed is:

1. A recording apparatus that performs a recording process on a subject recording medium, the recording apparatus comprising:

a recording unit that performs a recording process on the subject recording medium;

a subject recording medium cassette body that accommodates the subject recording medium in a vertical posture or an inclined posture while being attached to the recording apparatus;

a subject recording medium cassette opening that is provided in the subject recording medium cassette body and supplies the subject recording medium therefrom;

a feeding roller that supplies the subject recording medium from the subject recording medium cassette opening to the recording unit;

a movable portion that is provided in the subject recording medium cassette body and moves the subject recording medium accommodated in the subject recording medium cassette body in a direction in which the subject recording medium comes into contact with the feeding roller; and an insertion portion that is provided in the movable portion so that the feeding roller is able to be inserted therethrough and is set to be shorter than the length of the width direction intersecting the transportation direction of the subject recording medium.

2. The recording apparatus according to claim 1, wherein the insertion portion includes a plurality of partial insertion portions through which a plurality of roller bodies attached to a roller shaft of the feeding roller at an interval are respectively inserted.

3. The recording apparatus according to claim 1, further comprising:

a forward moving mechanism that biases the movable portion so as to move from a separation position in which the feeding roller and the recording medium are separated from each other to a contact position in which the feeding roller and the recording medium come into contact with each other;

a backward moving mechanism that moves the movable portion from the contact position to the separation position against the biasing force of the forward moving mechanism; and a power transmission mechanism that transmits power from a power supply source to the backward moving mechanism whenever supplying each recording medium.

4. The recording apparatus according to claim 3, wherein the forward moving mechanism includes a pressing arm which is rotatably supported by using the base end thereof as a support axis and of which the front end comes into contact with the subject recording medium cassette body and a spring that rotatably biases the pressing arm.

* * * * *